US007819059B2

(12) United States Patent
Mori

(10) Patent No.: US 7,819,059 B2
(45) Date of Patent: Oct. 26, 2010

(54) IMAGE FORMING APPARATUS

(75) Inventor: Hirotaka Mori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/339,376

(22) Filed: Dec. 19, 2008

(65) Prior Publication Data

US 2009/0116871 A1 May 7, 2009

Related U.S. Application Data

(63) Continuation of application No. 11/677,399, filed on Feb. 21, 2007, now Pat. No. 7,481,164.

(30) Foreign Application Priority Data

Mar. 1, 2006 (JP) ..... 2006-055196

(51) Int. Cl.
*B41F 35/00* (2006.01)

(52) U.S. Cl. ..... 101/425; 101/423

(58) Field of Classification Search ..... 101/425, 101/423

See application file for complete search history.

(56) References Cited

U.S. PATENT DOCUMENTS 4,796,057 A 1/1989 Howard et al.
5,189,470 A * 2/1993 Matsuda et al. ..... 399/68
5,570,164 A 10/1996 Yamamoto et al.
5,678,134 A 10/1997 Miki et al.
5,685,043 A 11/1997 LaManna et al.
5,911,101 A * 6/1999 Park ..... 399/345
5,983,050 A 11/1999 Takekoshi et al.
6,104,888 A 8/2000 Kobayashi
6,336,025 B1 * 1/2002 Saeki ..... 399/301
6,430,383 B1 8/2002 Sugiyama et al.
6,633,733 B2 10/2003 Mochimaru et al.
6,801,742 B1 * 10/2004 Mochimaru et al. ..... 399/309
6,907,217 B2 6/2005 Hattori
7,407,279 B2 * 8/2008 Nakashima ..... 347/104
2003/0118367 A1 * 6/2003 Omata et al. ..... 399/110
2004/0022557 A1 * 2/2004 Kudo ..... 399/167
2006/0285872 A1 * 12/2006 Fukuta et al. ..... 399/99

FOREIGN PATENT DOCUMENTS

JP 4-24771 2/1992
JP 11143304 5/1999
JP 2000235335 8/2000
JP 2001109338 4/2001
JP 2003208060 7/2003

* cited by examiner

*Primary Examiner*—Anthony H. Nguyen
(74) *Attorney, Agent, or Firm*—Banner & Witcoff, Ltd.

(57) ABSTRACT

An image forming apparatus includes is described in which a cleaning member is positioned on one side of a belt and a backup member positioned on a second side of the belt. The backup member is configured to move between a contact position and a non-contact position.

12 Claims, 36 Drawing Sheets

IMAGE FORMING APPARATUS

CROSS REFERENCE TO RELATED APPLICATION

This application claims priority from Japanese Patent Application No. 2006-055196 filed Mar. 1, 2006, and U.S. patent application Ser. No. 11/677,399, filed Feb. 21, 2007. The entire contents of these priority applications are incorporated herein by reference.

TECHNICAL FIELD

The disclosure relates to an image forming apparatus.

BACKGROUND

Generally, an image forming apparatus such as a laser printer which employs a belt for feeding sheets or performing an intermediate transfer has been well known. The aforementioned image forming apparatus is generally provided with a belt cleaning unit equipped with a roller and a brush to remove foreign matters adhered onto the belt, for example, toner or paper dust.

SUMMARY

One aspect of the present invention relates to an image forming apparatus.

BRIEF DESCRIPTION OF THE DRAWINGS

Illustrative aspects in accordance with the invention will be described in detail with reference to the following figures wherein.

DETAILED DESCRIPTION

Figure 1:
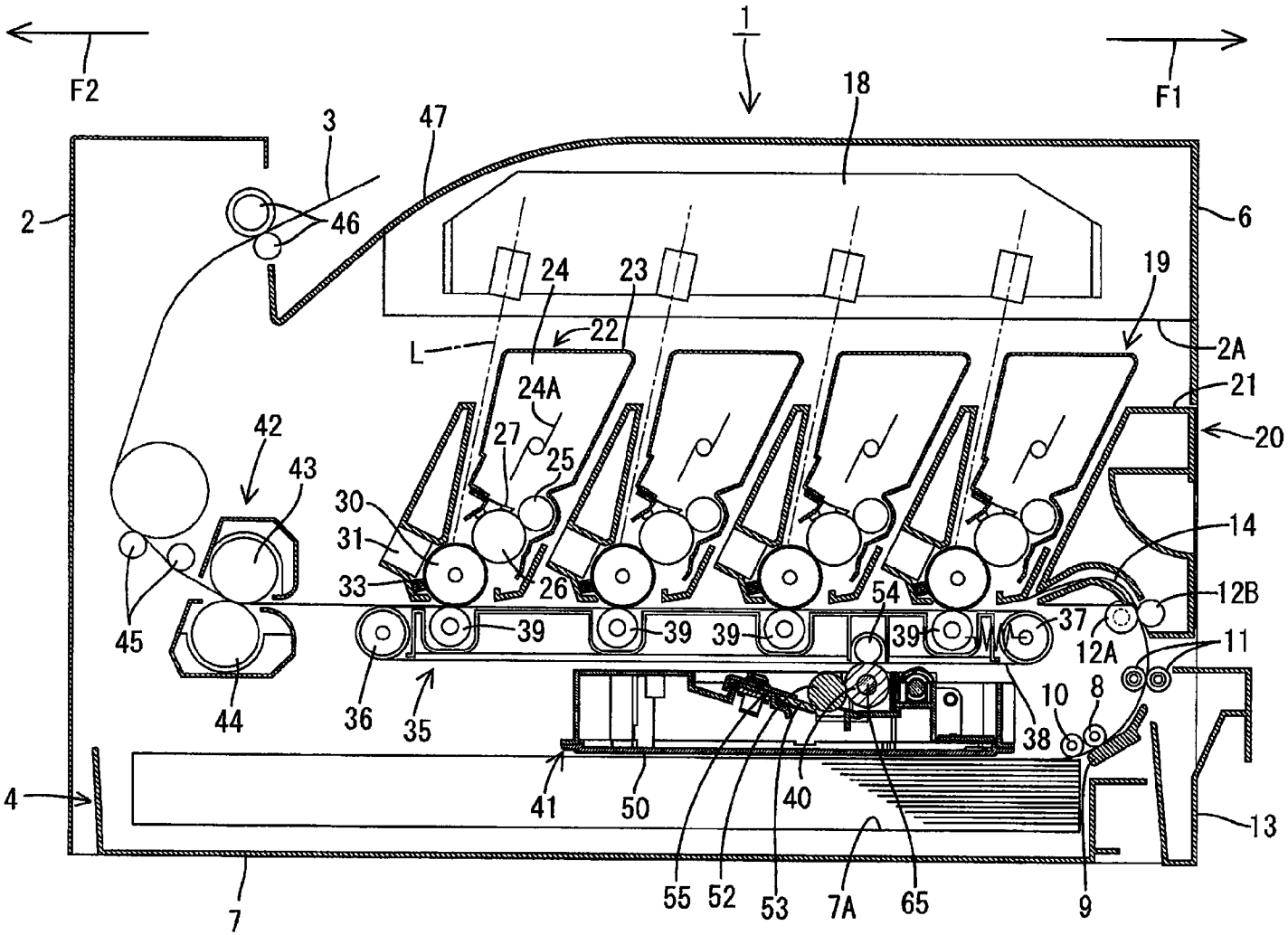
FIG. 1 is a sectional side elevation schematically showing a structure of a laser printer 1 according to one aspect of the invention.

One aspect of the invention will be described referring to the drawings.

<1. General Structure>

FIG. 1 is a sectional side elevation schematically showing the structure of a laser printer 1 as an image forming apparatus according to an aspect of the invention. Those skilled in the art will appreciate that, although this and other aspects refer to a laser printer, that the present invention is workable in other types of printers, and thus is not limited to implementation in a laser printer. The laser printer 1 is a color laser printer of direct tandem type including four photoconductor drums 30 corresponding to the respective colors of black, cyan, magenta, and yellow. The laser printer 1 includes a feeder 4, a scanner unit 18, an image forming unit 20, a sheet carrier 35, a cleaning unit 41, and the like within a body casing 2.

The feeder 4 feeds a sheet 3 as a recorded medium. The scanner unit 18 exposes the aforementioned photoconductor drums 30. The image forming unit 20 forms an image on the fed sheet 3. The sheet carrier 35 carries the sheet 3 to the image forming unit 20. The cleaning unit 41 works as a belt cleaning device. In the aspect, the sheet carrier 35 as a belt unit is allowed to be installed or detached through an opening 2A (described later) formed in the body casing 2. The cleaning unit 41 is detachably installed through the opening 2A as well. In the description, the direction of arrow F1 shown in FIG. 1 represents the front, and the direction of arrow F2 opposite the F1 represents the rear hereinafter.

<Feeder>

The feeder 4 includes a detachably mountable feeder tray 7, a separation roller 8 and a separation pad 9 provided above the front end of the feeder tray 7, a pickup roller 10 provided to the rear of the separation roller 8, a pair of rollers 11 and 11 for removing the paper dust arranged above the front side of the separation roller 8, and a pair of registration rollers 12A and 12B provided above the rollers 11 and 11 on the bottom of the body casing 2.

The feeder tray 7 is formed as a short box having its upper surface opened for accommodating the sheet 3 on which the image is formed to be stacked therein. One skilled in the art will appreciate that a sheet generally refers to any recording medium, such as paper, plastic or the like. A front wall 13 at the front end of the feeder tray 7 is arranged at the lower portion of the front cover 6 on the front surface of the body casing 2. The feeder tray 7 may be horizontally drawn to the front of the body casing 2 by pulling the front wall 13 to the front. A platen 7A that allows the sheets 3 to be stacked is provided on the bottom of the feeder tray 7. The platen 7A is rotatably supported at the rear end, and has its front end urged upward by a spring (not shown). The front end of the sheets 3 stacked within the feeder tray 7 is then urged upward.

The uppermost one of the sheets 3 in the feeder tray 7 is pressed toward the pickup roller 10 under the urging force applied by the platen 7A. The pickup roller 10 rotates to start carrying the sheet through between the separation roller 8 and the separation pad 9. When the sheet 3 is interposed between the separation roller 8 and the separation pad 9 through the rotation of the separation roller 8, it may be separated and fed one by one. Thus, a fed sheet is subjected to the process for removing the paper dust by the roller 11, and further fed to the registration rollers 12A and 12B.

The registration rollers 12A and 12B are formed as the drive roller 12A and the driven roller 12B, respectively to turn back the sheet 3 (after the registration of the leading-edge of the sheet 3) onto a sheet carrier belt 38 of a sheet carrier unit 35 (described later) via a feed path 14 having a general U-shape configuration directed from the front to the rear.

Scanner

The scanner unit 18, serving as an exposure unit, is disposed at the upper most portion of the body casing 2. The scanner unit 18 irradiates the laser light L for each color based on the predetermined image data on the surface of the corresponding photoconductor drum 30 at high speed scanning. Laser beams L, each representing a color, are irradiated from the bottom surface of the scanner unit 18 diagonally downward. The light paths of the respective laser beams L are apart from one another in parallel at predetermined intervals.

<Image Forming Unit>

The opening 2A is formed in the front surface of the body casing 2 above the feeder tray 7. The opening 2A is opened and closed by a front cover 6 having its lower end axially supported. The body casing 2 includes a unit storage portion 19 communicated with the opening 2A below the scanner unit 18 for accommodating the image forming unit 20 that can be drawn forward and detachably installed. The image forming unit 20 is provided with a frame 21 which holds the photoconductor drums 30, each serving as an image carrier, a charger 31 (i.e. of the scorotron type) serving as a charging unit, development cartridges 22 serving as a development unit, and a cleaning brush 33. As the development cartridges 22 corresponding to the respective colors (i.e. black, cyan, magenta and yellow) have the same structures, only the leftmost one shown in FIG. 1 will be designated with the reference numerals. Reference numerals for the other structures, thus, will be omitted.

The development cartridges 22 are detachably held at the frame 21. The development cartridge 22 includes a box-like storage case 23 having the lower portion opened, and a toner storage chamber 24 at its upper portion which contains a positively charged toner T (i.e. polymerized toner, developer) having a nonmagnetic single content for each respective color and formed at the upper portion of the storage case 23. An agitator 24A is disposed in the toner storage chamber 24 which is driven by a motor (not shown) to rotate for agitating the toner inside the toner storage chamber 24. A feed roller 25, a development roller 26 serving as a carrier of the development agent, and a layer thickness regulation blade 27 are disposed in the lower portion of the toner storage chamber 24.

A feed roller 25 is rotatably supported in a storage case 23 of the development cartridge 22, which can be formed by coating a metal roller shaft with a roller formed of a conductive foaming material. The feed roller 25 is driven to rotate through input of driving force of a motor (not shown)

A development roller 26 is rotatably supported in the storage case 23 of the development cartridge 22 in press contact with the feed roller 25 diagonally downward thereof. The development roller 26 is brought into contact with the photoconductor drum 30 to face with each other in the state where the development cartridge 22 is supported by the frame 21. The development roller 26 can be formed by coating the metal roller shaft with a roller body. The Roller body can be formed of conductive urethane rubber or silicon rubber which contains carbon particles. A coat layer of the urethane rubber or the silicon rubber which contains fluorine can be applied to the surface of the roller body. The development roller 26 is applied the development bias during the development process, and is driven to rotate through input of the driving force applied from a motor (not shown).

The layer thickness regulation blade 27 includes a blade body and a pressure portion disposed at the top end of the blade body. The pressure portion can be formed of an insulating silicon rubber with a semispherical cross section. The blade body can be formed of a metal plate spring member. The layer thickness regulation blade 27 is supported in the storage case 23 above the development roller 26, and has the pressure portion brought into press contact with the development roller 26 under the elastic force of the blade body.

During the development, the feed roller 25 rotates to supply the toner T discharged from the toner storage chamber 24 to the development roller 26 such that the toner T is positively friction-charged between the feed roller 25 and the development roller 26. Accompanied with the rotation of the development roller 26, the toner T supplied on the development roller 26 is fed between the layer thickness regulation blade 27 and the development roller 26 so as to be further friction-charged sufficiently, and carried on the development roller 26 as the thin layer with a thickness.

The photoconductor drum 30 is cylindrical and includes a grounded metal drum body having its surface coated with a positively chargeable photoconductor layer. A metal drum shaft serving as an axis that extends along the longitudinal direction of the drum body at the shaft center is supported at the frame 21 such that the photoconductor drum 30 is rotatably disposed. The photoconductor drum 30 is driven to rotate through input of the driving force of a motor (not shown).

A charger 31 is disposed opposite the photoconductor drum 30 at a distance so as not to contact with each other, and at diagonally upward to the rear of the photoconductor drum 30. The charger 31 generates corona-discharges from a charging wire such as tungsten. The charger positively charges the entire surface of the photoconductor drum 30.

The cleaning brush 33 is disposed opposite the photoconductor drum 30 in contact therewith to the rear thereof.

While the photoconductor drum 30 is rotating, its entire surface is positively charged at +900V, for example, by the charger 31. It is then exposed through the high speed scan of the laser beam from the scanner unit 18 to make the partial surface potential at +100V such that the electrostatic latent image corresponding to the image to be formed on the sheet 3 is formed.

The toner T is positively charged at +450V, for example. When the toner T carried on the development roller 26 is brought into contact with the photoconductor drum 30 accompanied with the rotation of the development roller 26, the toner T is supplied to the electrostatic latent image formed on the surface of the photoconductor drum 30. The electrostatic latent image on the photoconductor drum 30 is visualized such that the toner image (development agent image) is carried on the photoconductor drum 30 through the reversal phenomenon.

The toner image carried on the surface of the photoconductor drum 30 is transferred to the sheet 3 through the negative transfer bias (for example, −700V) applied to the transfer roller 39 while the sheet 3 to be carried by the sheet carrier belt 38 passes the transfer position between the photoconductor drum 30 and the transfer roller 39. The sheet 3 on which the toner image has been transferred is fed to a fixation unit 42.

<Sheet Carrier Unit>

The sheet carrier unit 35 is disposed below the image forming unit 20 installed in the unit storage portion 19. The sheet carrier unit 35 is formed of a pair of belt support rollers 36 and 37 provided at the rear and front sides in parallel at an interval, and a sheet carrier belt 38 (corresponding to the belt) that extends between those rollers 36 and 37. The sheet carrier belt 38 is allowed to operate when the belt support roller 36 at the rear side is driven to rotate under the driving force of the motor. The belt support roller (driving roller) 36 at the rear side can be formed by applying the rubber layer or coating layer on the surface of the substantially cylindrical metal base pipe formed of aluminum or stainless steel for obtaining the grip force with the inner surface of the belt. The belt support roller (tension roller) 37 at the front side can be formed by plating the surface of substantially the cylindrical metal base pipe formed of aluminum or stainless steel for preventing the surface friction against the inner surface of the belt. The sheet carrier belt 38 can be formed of the resin material, for example, polycarbonate, and has its width to equal to or larger than that of maximum printable sheet size (in the aspect, size A4, for example).

Transfer rollers 39 are arranged at predetermined intervals opposite the photoconductor drums 30 for the aforementioned image forming units 20 inside the sheet carrier belt 38. The sheet carrier belt 38 is interposed between the respective photoconductive drums 30 and the opposite transfer rollers 39. Each of the transfer rollers 39 is formed by coating the elastic material such as a conductive rubber material around the metallic roller shaft. The transfer rollers 39 apply the negative transfer bias during the transfer. Disposed below the sheet carrier belt 38, the cleaning unit 41 including the cleaning roller 40 for eliminating the residual toner T and the paper dust adhered on the sheet carrier belt 38. The sheet 3 fed from the aforementioned registration rollers 12A and 12B abuts the portion around the front end of the upper surface of the sheet carrier belt 38 through the feeder path 14. It is subjected to the electrostatic adsorption on the upper surface of the sheet carrier belt 38, and is fed rearward accompanied with the circular movement of the sheet carrier belt 38.

<Fixation Unit>

The fixation unit 42 is disposed to the rear of the sheet carrier unit 35 in the body casing 2. The fixation unit 42 is formed of a heat roller 43, a pressure roller 44 and the like arranged opposite with each other so as to thermally fix the toner image transferred to the sheet 3 on the sheet surface. The thermally fixed sheet 3 is fed into a discharge roller 46 at the upper portion of the body casing 2 by the feed roller 45 disposed diagonally upward of the fixation unit 42. A catch tray 47 is disposed on the upper surface of the body casing 2. The front end of the catch tray 47 is substantially horizontal. The rear end of the catch tray 47 is inclined downward. The sheet 3 after the image formation, discharged from the discharge roller 46 is stacked on the catch tray 47.

<2. Electrical Structure>

The electric structure of the laser printer 1 will be described.

Figure 2:
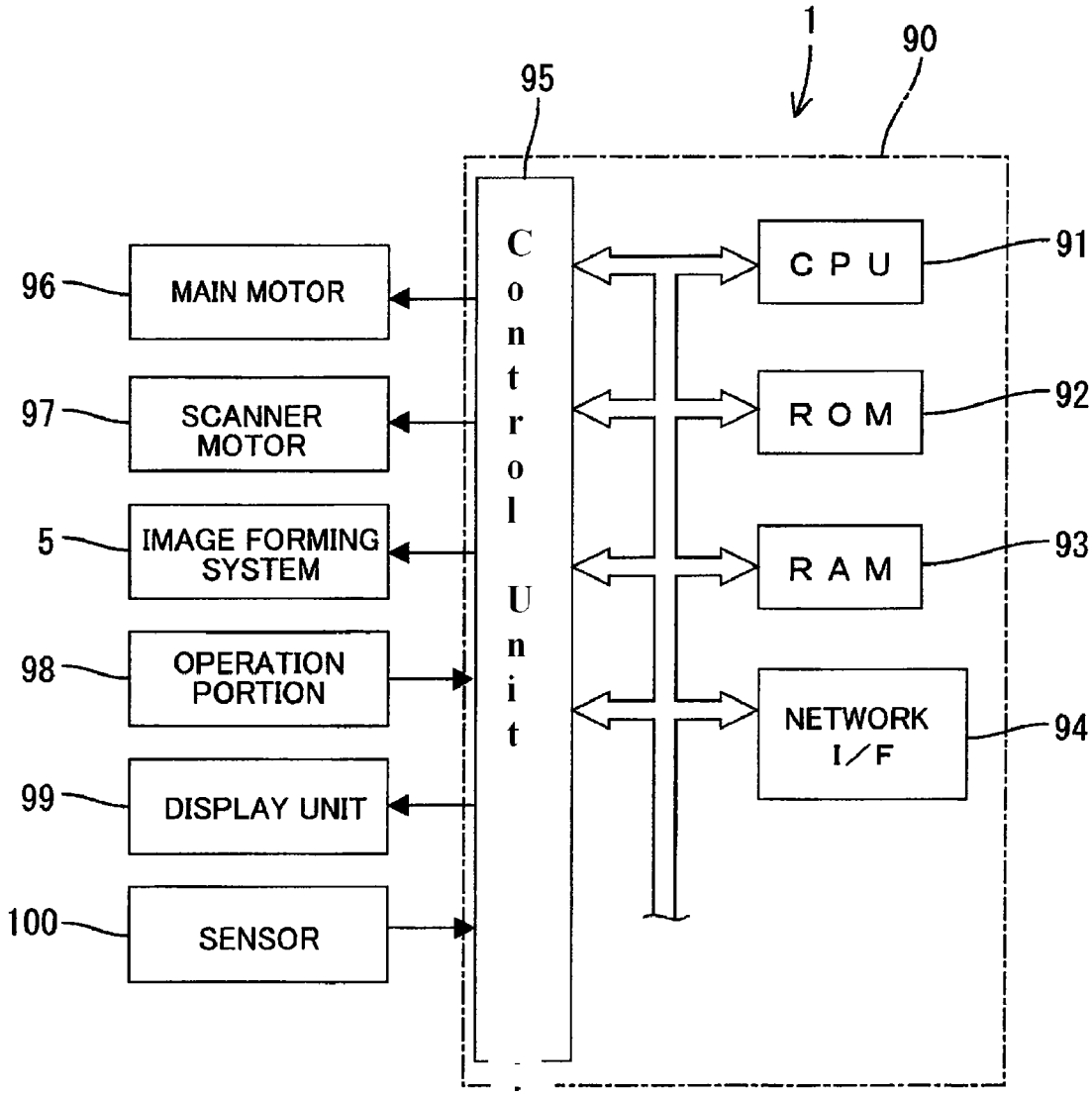
FIG. 2 is a block diagram of an electric structure of the laser printer 1 shown in FIG. 1.

FIG. 2 is a block diagram that schematically shows the electric structure of the laser printer 1.

The laser printer 1 can include a control system 90 having a CPU 91, a ROM 92, a RAM 93 and a control unit 95 formed of an ASIC (Application Specific Integrated Circuit) for controlling the respective components. A main motor 96, a scanner motor 97, an image forming system 5, an operation portion 98 including an input panel, a display unit 99 formed of various lamps, and a sensor 100 (to be described later) are electrically coupled with the control unit 95. The control system can include the aforementioned components. The image forming system 5 can be formed of the aforementioned feeder 4, the scanner unit 18, the image forming unit 20, the sheet carrier unit 35, and the fixation unit 42, respectively.

The ROM 92 and the RAM 93 are connected to the CPU 91 which allows the control unit 95 to control the respective components in accordance with the procedure stored in the ROM 92 while storing the processing results in the RAM 93.

The main motor 96 rotates the aforementioned sheet carrier belt 38 and the like. The scanner motor 97 rotates a polygon mirror (not shown) within the scanner unit 18. The CPU 91 controls the main motor 96 and the scanner motor 97 based on the program preliminarily stored in the ROM 92.

The control unit 95 controls the image forming system 5 in accordance with the command from the CPU 91, specifically, executes the exposure which allows the respective portions that form the scanner unit 18 to expose the surface of the photoconductor drum 30, controls the transfer bias upon transfer of the toner to the sheet 3, and the like.

The control system 90 includes a network interface (network I/F) 94 for connection with external devices, for example, a personal computer.

<3. Basic Structure of Cleaning Unit>

Figure 3:
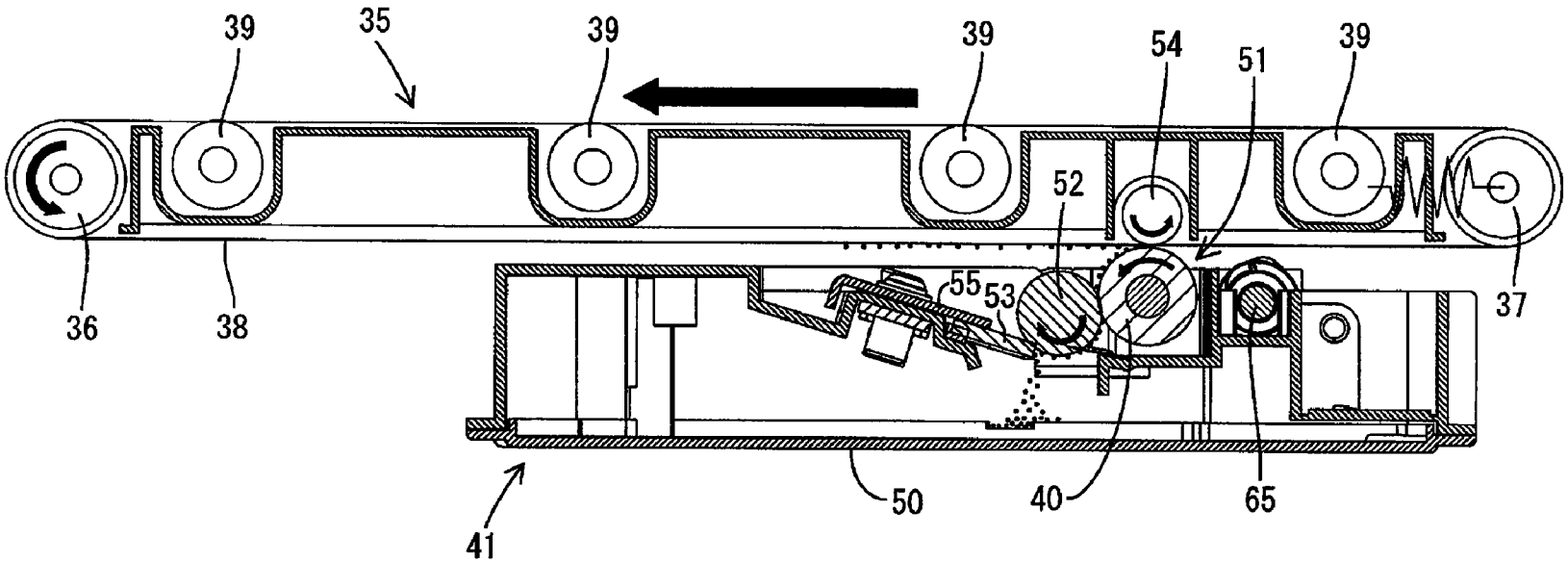
FIG. 3 is a sectional side elevation showing an enlarged view of a sheet carrier unit and a belt cleaning unit of the laser printer 1 shown in FIG. 1.

FIG. 3 is a sectional side elevation showing an enlarged view of the sheet carrier unit 35 and the cleaning unit 41.

The cleaning unit 41 is detachably installed in the body casing 2, and provided with a box-like case 50 with a long longitudinal length below the sheet carrier belt 38. A portion of the frame with which the case 50 is integrally formed is provided with pairs of engagement protrusions 70, 70 and 71, 71 (See FIG. 4 for the engagement protrusions 70, 70 and 71, 71) which are engaged with a frame portion of the main body of the apparatus (part of the laser printer except the cleaning unit 41).

The case 50 has an opening 51 at its front end of the upper surface. A cleaning roller 40 as the cleaning member is rotatably disposed inside the opening 51. The cleaning roller 40 is a silicon foaming roller, which can be formed by coating a metallic roller shaft with a roller body formed of the conductive foaming material. In this aspect of the invention, the foreign matter adhered onto the carrier belt 38, which has been removed by the cleaning mechanism (cleaning roller 40 and the backup roller 54), is stored in the case 50 corresponding to the storage box. The case 50 is provided integrally with the frame portion of the cleaning unit 41.

A metal roller 52, which can be formed of a hard material such as metal, is rotatable disposed diagonally downward to the rear of the cleaning roller 40 in press contact therewith.

A rubber scratch blade 53 serving as a scratch member is disposed below the metal roller 52. The rear end of the rubber scratch blade 53 is gripped by a metallic holder 55 so as to be held and fixed. The metallic holder 55 is serving as a holding member. The front end of the rubber scratch blade 53 is a free end. The front end of the rubber scratch blade 53 is brought into press contact with the lower surface of the metal roller 52 under the elastic force of the blade body. In order to bring the rubber scratch blade 53 into contact with the metal roller 52 over the whole length in the longitudinal direction under uniform force, the rear end of the scratch blade 53 can be held and fixed with substantially strong force to a certain degree. Preferably, the holder 55 can be formed of a metal that exhibits relatively high strength. Meanwhile, the backup roller formed of the conductive member like metal is rotatably disposed above the cleaning roller 40 such that the sheet carrier belt 38 is positioned between the backup roller 54 as the upper side and the cleaning roller 40 as the lower side.

Referring to FIG. 3, after the passage of the sheet 3 (on which the image is formed) through the fixation unit 42 to the eject of the sheet 3 by the discharge roller 46, the cleaning roller 40 is driven to rotate in the direction opposite the direction at its contact surface with the sheet carrier belt 38. In this embodiment, the sheet carrier belt 38 circularly moves counterclockwise under the driving force of a motor (not shown), and the cleaning roller 40 is driven to rotate counterclockwise as shown in the drawing such that the metal roller 52 is driven to rotate clockwise as shown in the drawing. Meanwhile, the backup roller 54 rotates counterclockwise as shown in the drawing accompanied with the circular movement of the sheet carrier belt 38.

A roller shaft of the backup roller 54 is grounded. Upon cleaning operation, the cleaning roller 40 receives the negative bias at −3 kV, and the metal roller 52 receives the negative bias that is lower than the one applied to the cleaning roller 40 at −3.5 kV, for example. The bias suction force around the position where the cleaning roller 40 and the backup roller 54 face with each other and the force generated by the contact of the cleaning roller 40 allow the residual toner T and paper dust adhered onto the sheet carrier belt 38 to move toward the cleaning roller 40. Then the residual toner T and the like carried on the cleaning roller 40 is moved to the hard metal roller 52 under the suction force. The residual toner T carried on the metal roller 52 is scratched off by the scratch blade 53, and finally collected in the case 50.

<4. Pressure Force Adjusting Mechanism>

Figure 4:
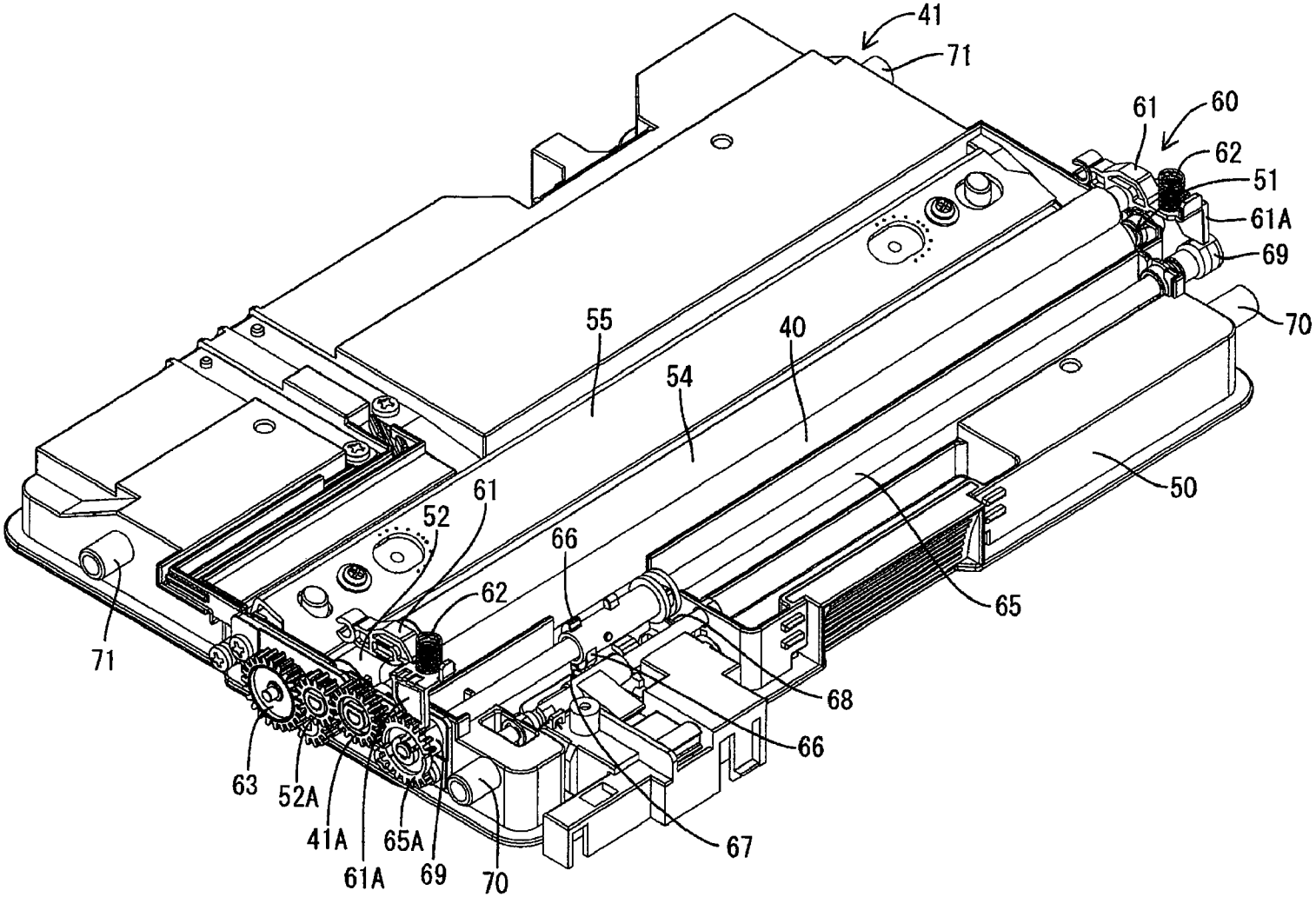
FIG. 4 is a perspective view showing a cleaning unit 41 and a pressure force adjusting mechanism 60.
Figure 5:
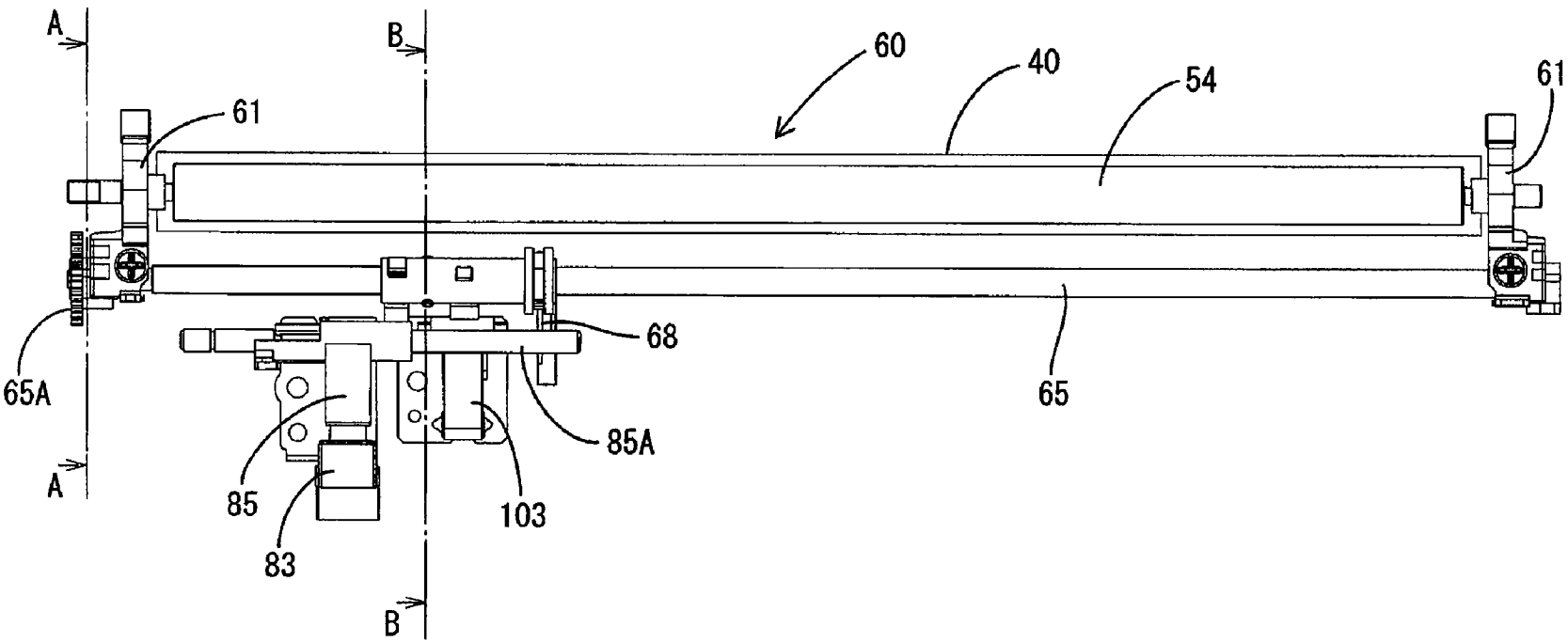
FIG. 5 is a top view of a portion of the pressure force adjusting mechanism 60.
Figure 6:
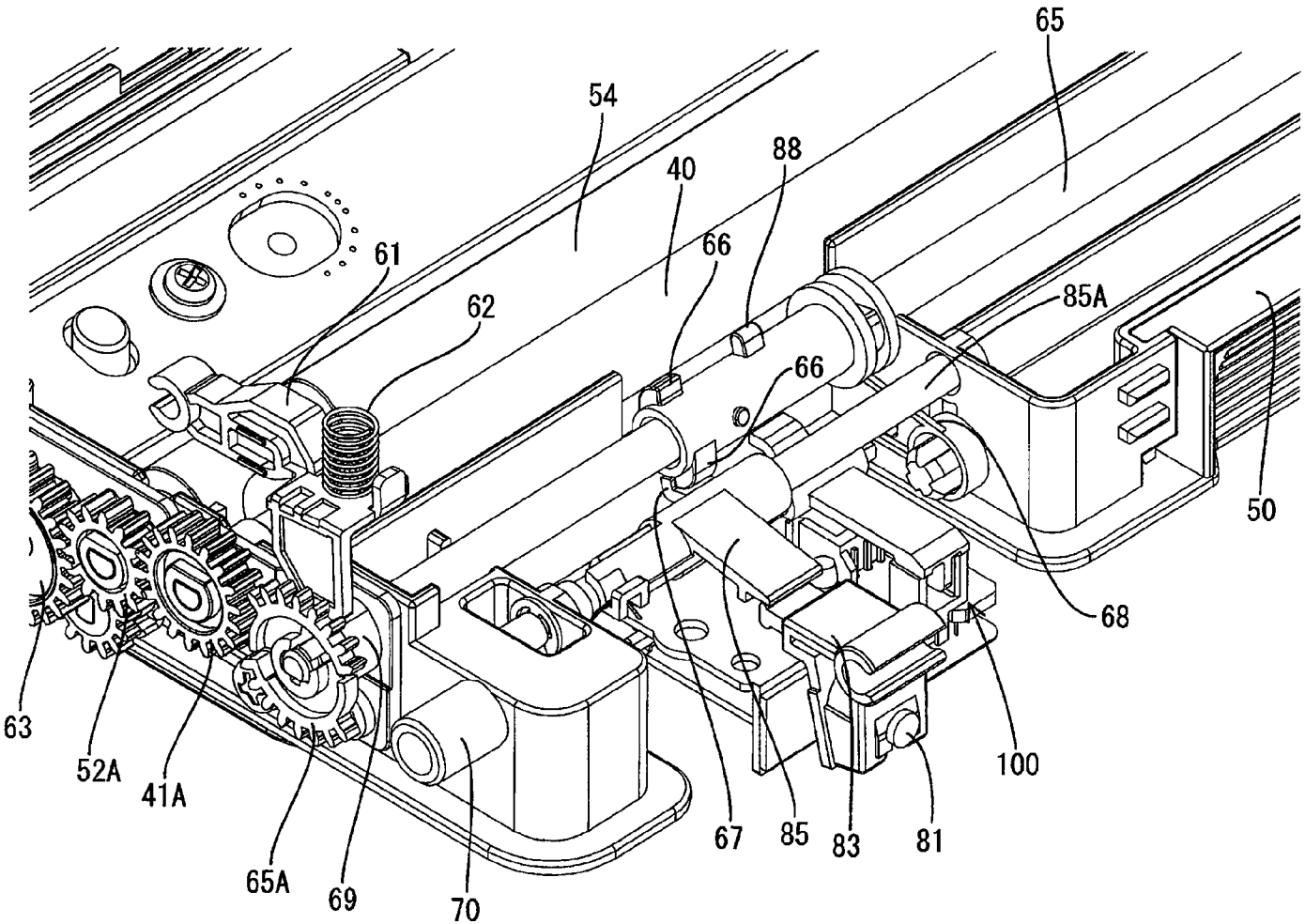
FIG. 6 is a partially enlarged perspective view of a portion of the pressure force adjusting mechanism 60.
Figure 7:
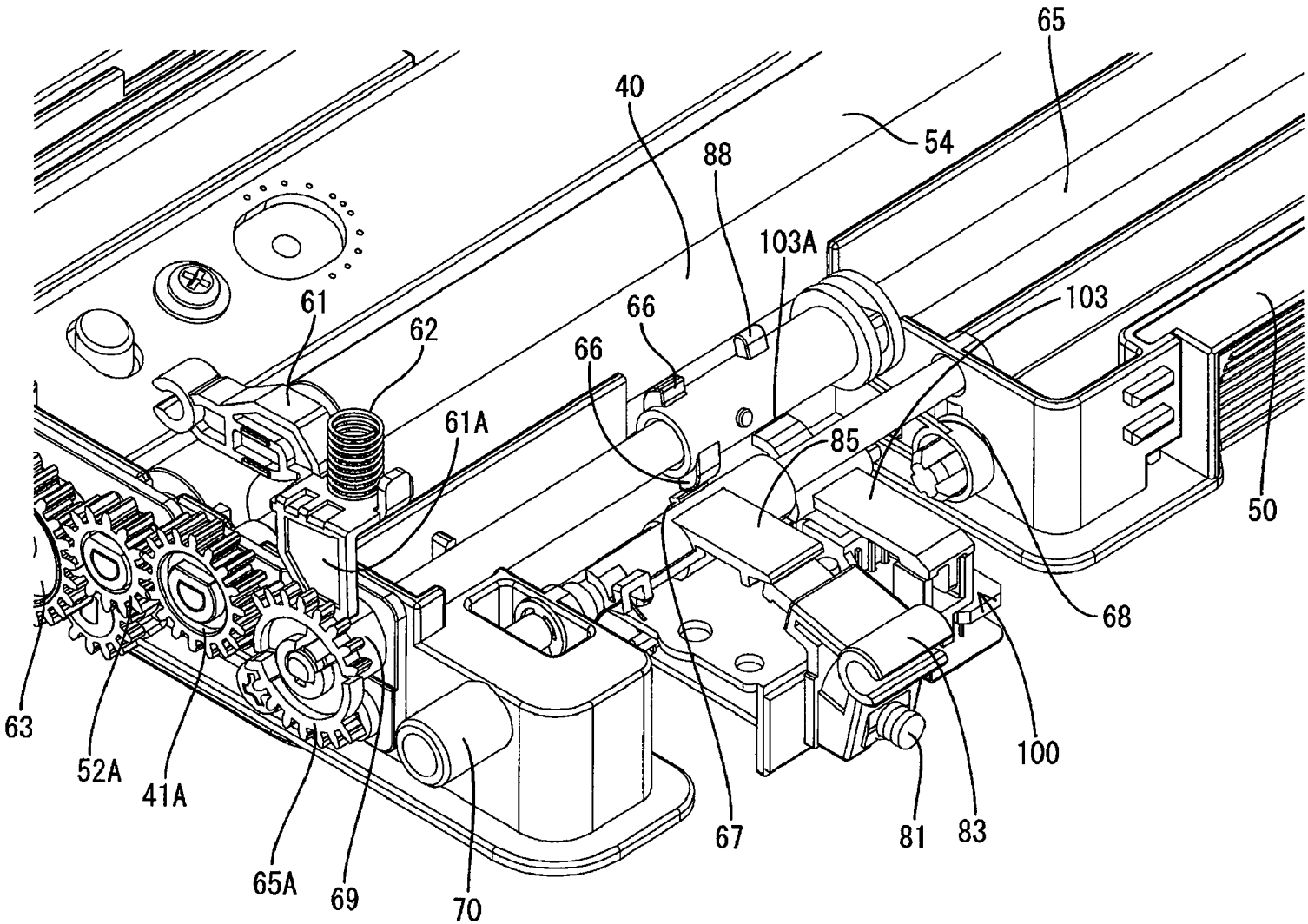
FIG. 7 shows the state immediately after driving the solenoid from the state shown in FIG. 6.
Figure 8:
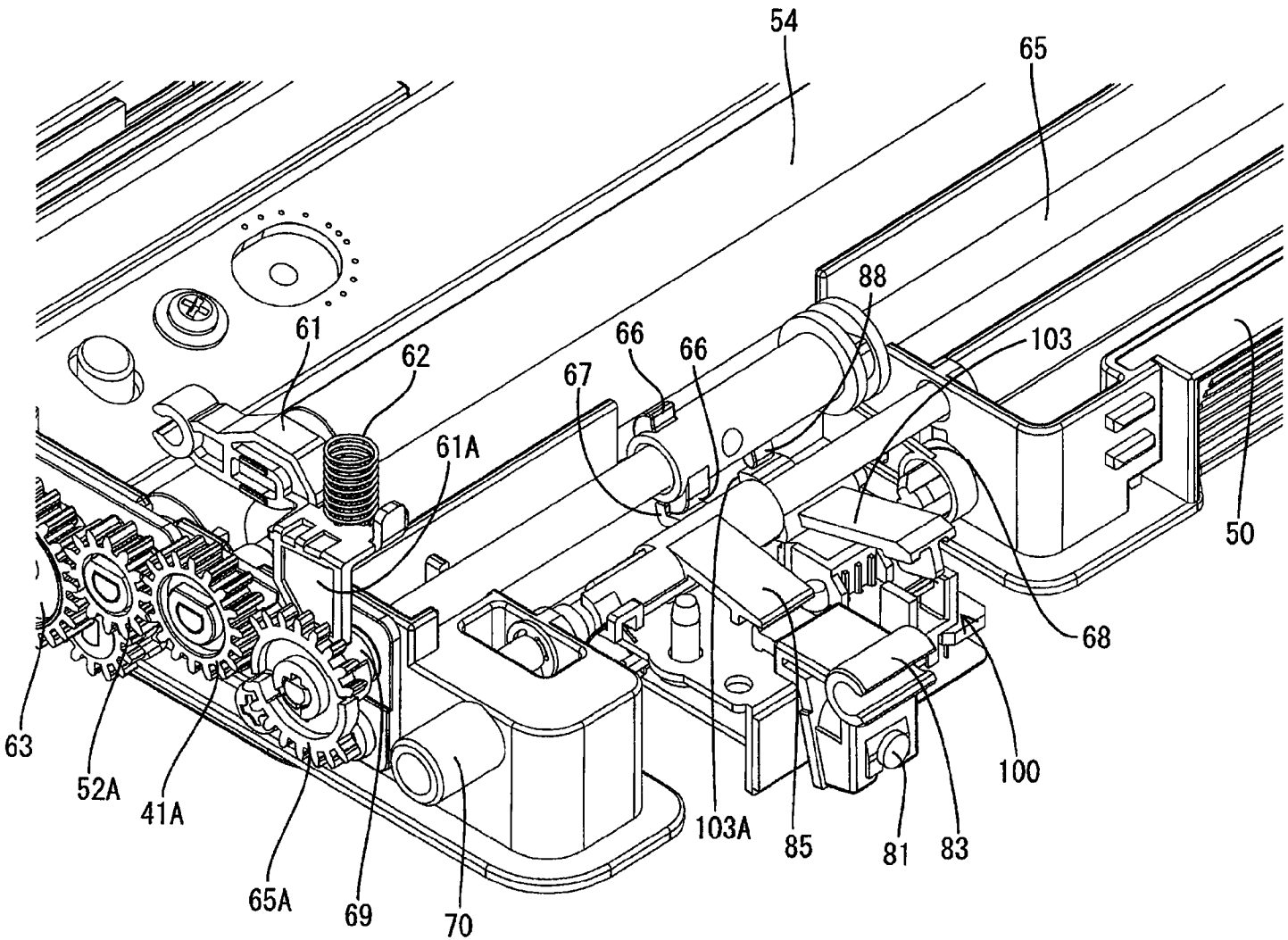
FIG. 8. shows the state where the first mode has been selected from the state shown in FIG. 6.
Figure 9:
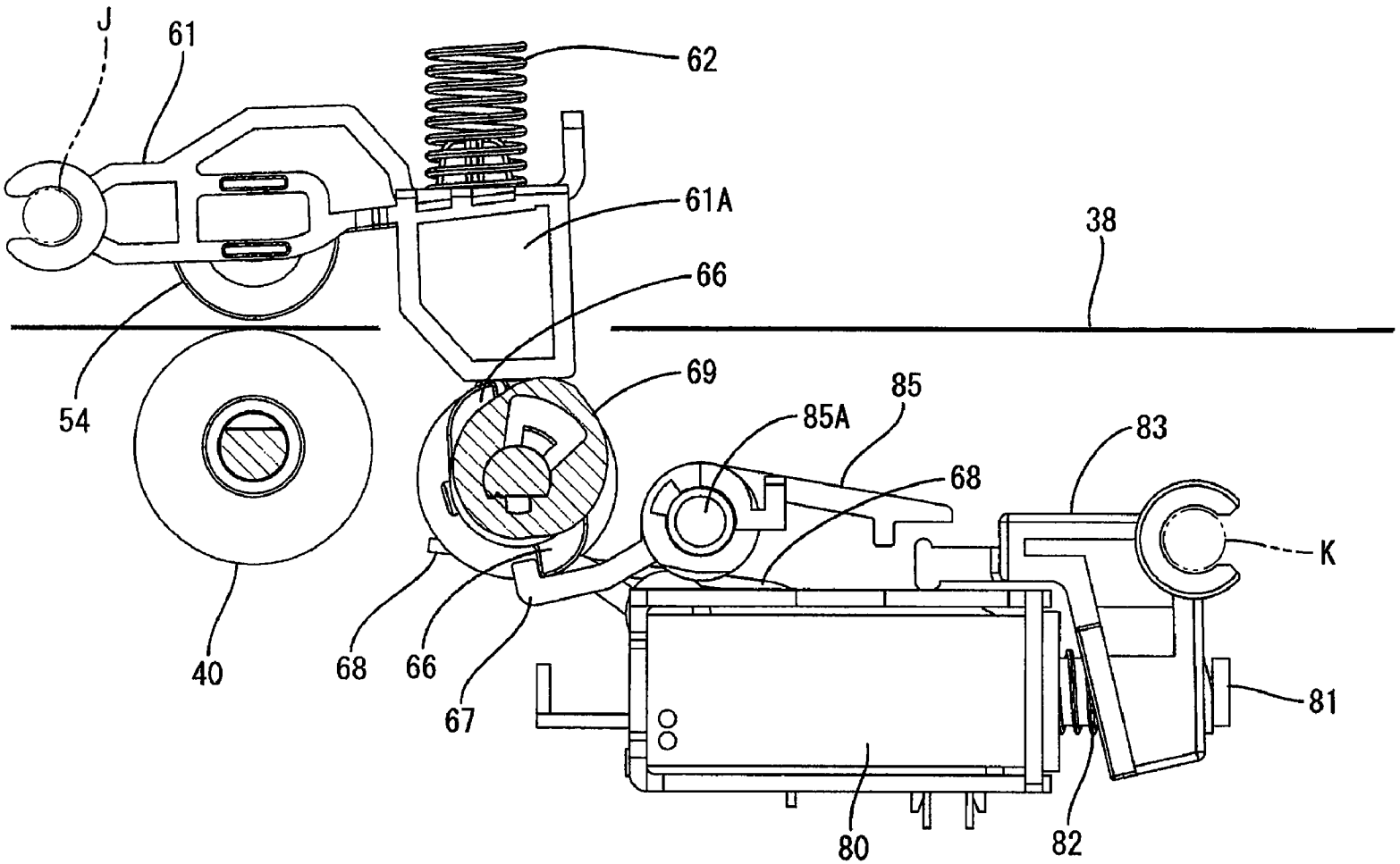
FIG. 9. is a sectional view taken along line A-A of FIG. schematically showing the state where the second mode has been set.
Figure 10:
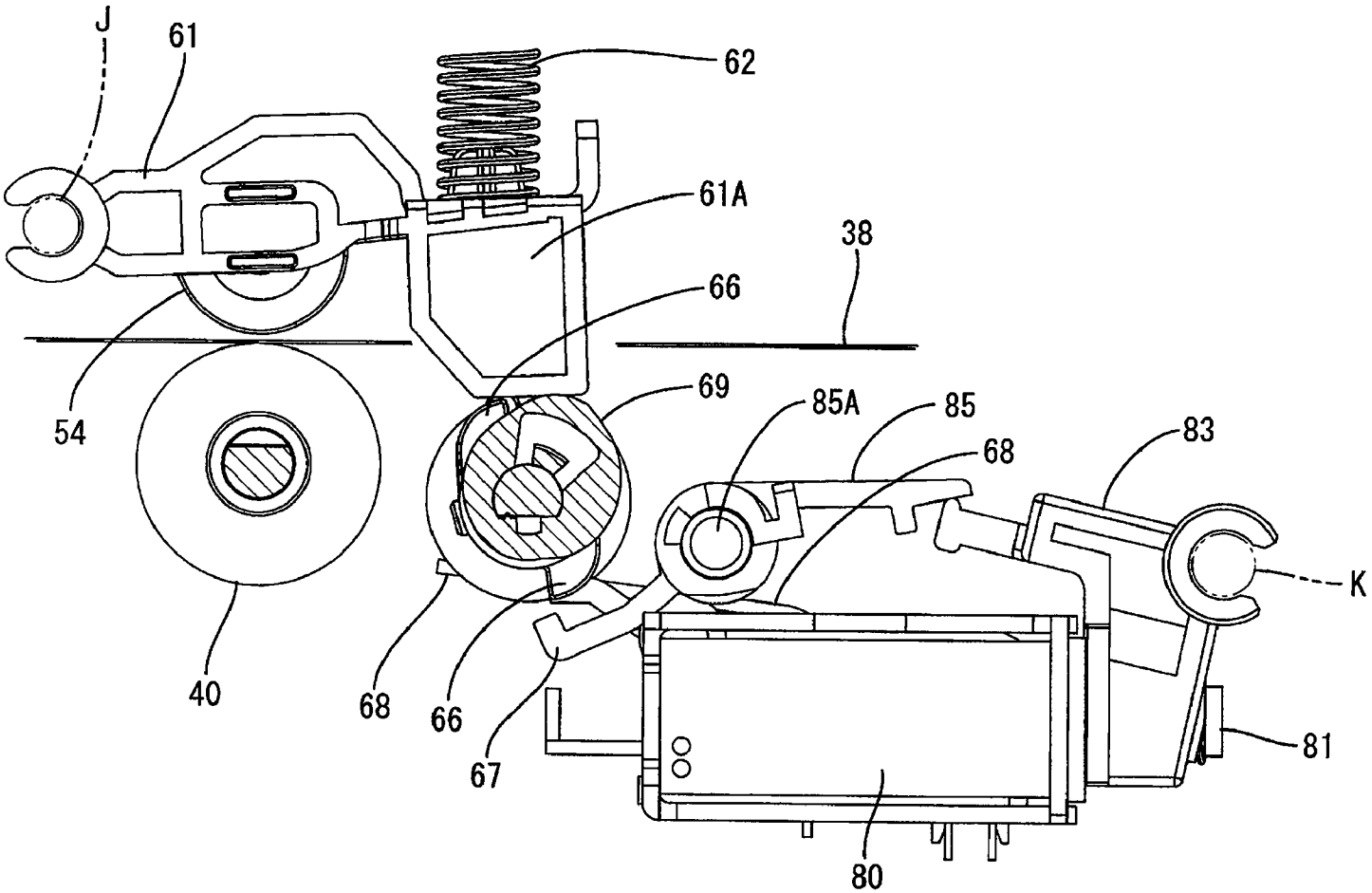
FIG. 10 shows the state immediately after driving the solenoid from the state shown in FIG. 9.
Figure 11:
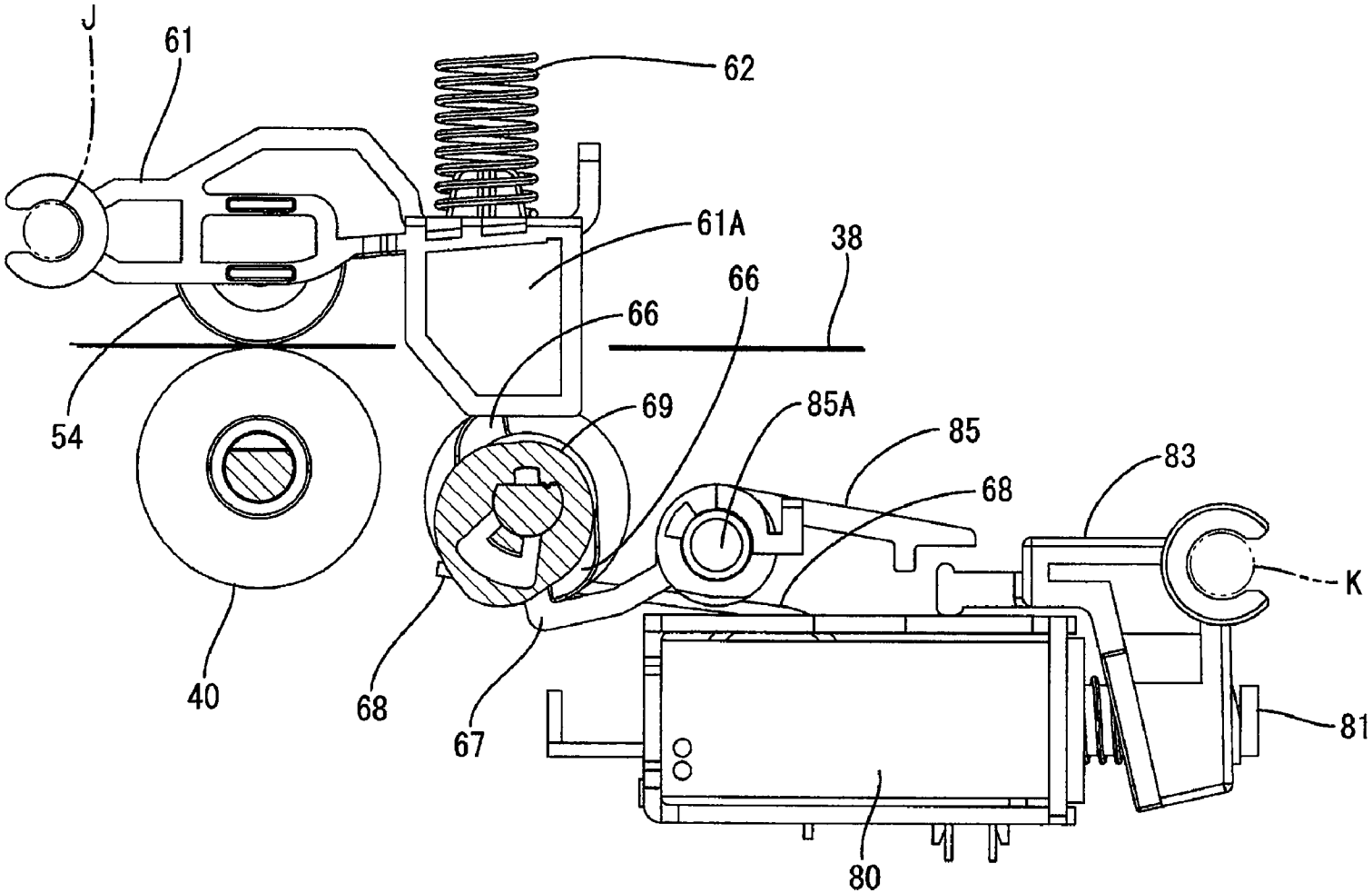
FIG. 11 shows the state where the first mode has been selected from the state shown in FIG. 9.
Figure 12:
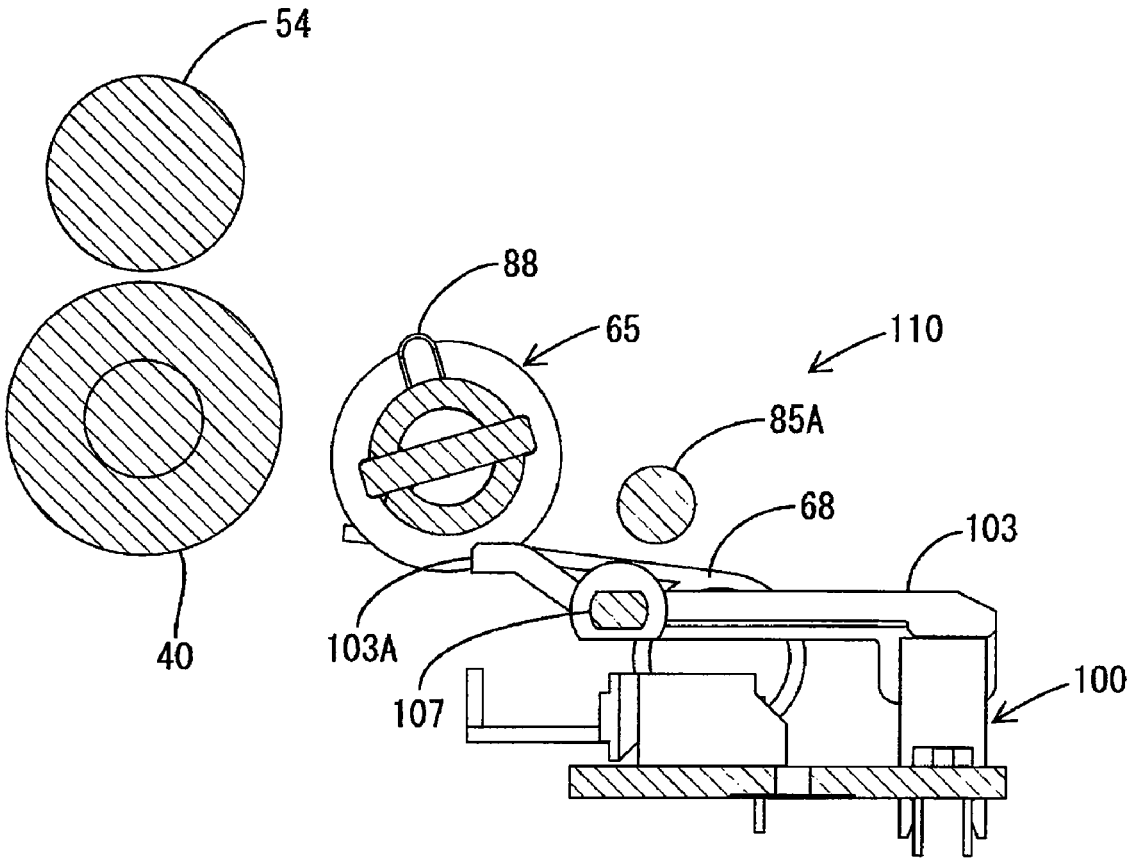
FIG. 12 is a sectional view taken along line B-B of FIG. 6 conceptually showing the structure around the interlock mechanism 110 and the sensor 100.
Figure 13:
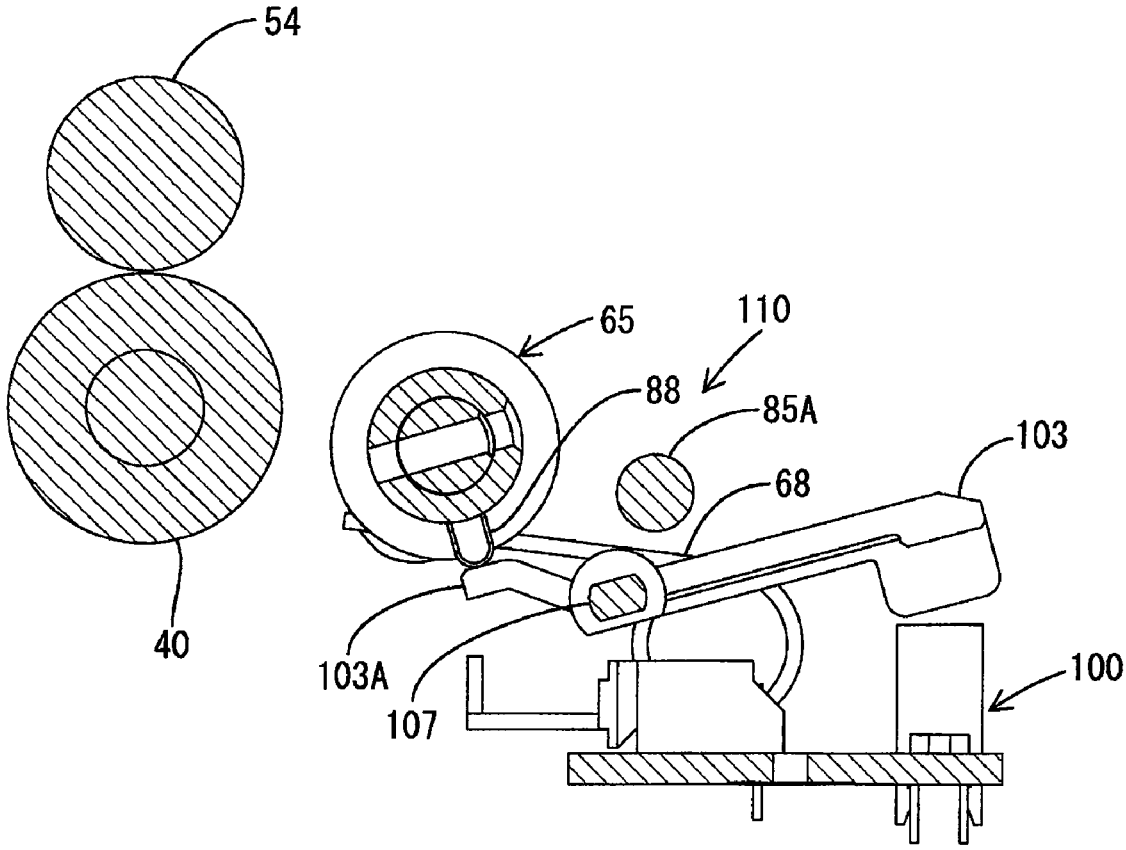
FIG. 13 shows the state where the first mode has been selected from the state shown in FIG. 12.

FIG. 4 is a perspective view showing the cleaning unit 41 and the pressure force adjusting mechanism 60. The lower right side of the drawing represents the front (at the side of the opening 2A of the body casing 2) of the laser printer 1. FIG. 5 is a top view of a portion of the pressure force adjusting mechanism 60. FIG. 6 is a perspective view of a partially enlarged portion of the pressure force adjusting mechanism 60 in the state where the second mode has been set. FIG. 7 is a view showing the state immediately after driving the solenoid from the state shown in FIG. 6. FIG. 8 shows the state where the first mode has been selected from the state shown in FIG. 6. FIG. 9 is a sectional view taken along line A-A of FIG. 5 schematically showing the state where the second mode is set. FIG. 10 shows the state immediately after driving the solenoid from the state shown in FIG. 9. FIG. 11 shows the state where the first mode has been selected from the state shown in FIG. 9. FIG. 12 is a sectional view taken along line B-B of FIG. 6 conceptually showing the structure around the interlock mechanism 110 and the sensor 100. FIG. 13 shows the state where the first mode has been selected from the state shown in FIG. 12. FIGS. 8, 11 and 13 represent the state of the first mode, and FIGS. 6, 9 and 12 represent the state of the second mode.

The laser printer 1 according to this aspect of the present invention is provided with the pressure force adjusting mechanism 60 for the backup roller 54 with respect to the cleaning roller 40 in the cleaning mode and the non-cleaning mode. More specifically, while the sheet 3 is carried on the sheet carrier belt 38 from the feeder tray 7 to transfer the toner image and to be thermally fixed by the fixation unit in response to a command for the image forming (the laser printer 1 is in the image forming operation), the pressure force adjusting mechanism 60 places the backup roller 54 at the position apart from the sheet carrier belt 38 (the pressure force adjusting mechanism 60 is in the non-cleaning operation). Meanwhile, while the pressure force adjusting mechanism 60 is in the cleaning operation, the pressure force adjusting mechanism 60 moves the backup roller 54 into contact with the sheet carrier belt 38 so as to be moved to the contact position between the backup roller 54 and the cleaning roller 40. This aspect is structured to press the backup roller 54 against the cleaning roller 40 only in the cleaning operation such that the contact pressure between backup roller 54 and cleaning roller 40 (or the cleaning pressure) required for the cleaning is obtained. In this case, the cleaning roller 40 and the metal roller 52 never exert the running load to the sheet carrier belt 38, whether in the cleaning operation or in the non-cleaning operation of the structure that is constantly driven to rotate. In the non-cleaning operation, the backup roller 54 does not have to be moved to the position completely apart from the sheet carrier belt 38. Those skilled in the art will understand that backup roller 54 may be brought into light contact with the sheet carrier belt 38 so long as the operation of the sheet carrier belt 38 is not interfered.

Referring to FIG. 4, the backup roller 54 is rotatably held at a pair of swing holding arms 61 and 61 at both ends (left and right ends). Each of the swing holding arms 61 has its front end swingable up and down at the rear end and axially supported with a support shaft (not shown in FIG. 4, and shown by a chain in line J in FIGS. 9 to 11) provided at the side of the body casing 2 in parallel with the backup roller 54. The swing holding arm 61 has its swing end (front end) pressed downward (toward the cleaning unit 41) by a pressure spring 62 as the urging member. Referring to FIG. 4, the backup roller 54, the pair of swing holding arms 61 and the pressure springs 62 are installed in the sheet carrier unit 35 formed as the belt unit. The sheet carrier belt 38 should be shown as being in contact between the backup roller 54 and the cleaning roller 40. However, the sheet carrier belt 38 is not shown for illustrative simplicity.

The cleaning roller 40 includes a roller shaft supported at both ends which protrude from the left and right walls of the case 50. A rotary gear 41A is integrally provided with one of those ends (for example, the left end). The metal roller 52 includes a roller shaft supported at both ends which protrude from the left and right walls of the case 50. A rotary gear 52A is integrally provided with one of those ends (for example, the left end), and in mesh with the rotary gear 41A. An input gear 63 is disposed to the rear of the rotary gear 52A and in mesh therewith to be linked with gear. It is also in mesh with an output gear (not shown) at the side of the body casing to be linked with gear in the state where the cleaning unit 41 is installed in the body casing 2. An output gear (not shown) is disposed diagonally downward to the rear of the input gear 63, and driven to rotate upon reception of the driving force from the motor (not shown) in the body casing 2. The motor rotates in response to the image forming command, for example such that the driving force is transferred to the rotary gears 41A and 52A via the output gear and the input gear 63. As a result, the cleaning roller 40 and the metal roller 52 are driven to rotate.

A metallic shaft as a rotary shaft having both ends supported to protrude from the left and right walls of the case 50 is disposed to the front of the cleaning roller 40 in parallel therewith. A cut gear 65A having a pair of cut gear portions symmetrically arranged is integrally provided with one of those ends (for example, left end) of the metallic shaft 65. The metallic shaft 65 includes a pair of protrusions 66 and 66 that is symmetrically arranged with respect to the center axis. An engagement arm 67 engaged with one of those protrusions 66 and 66 is rotatably provided at the rotary position where the cut gear portion of the cut gear 65A faces the rotary gear 41A.

The engagement arm 67 is interlocked with the solenoid 80. Upon reception of the command signal for the image forming operation or the command signal for the cleaning operation, the solenoid 80 is turned ON to release the engagement between the engagement arm 67 and the protrusion 66. The metallic shaft 65 is forced by the coil spring 68 as the urging member to rotate to the position at which the gear portion of the cut gear 65A is in mesh with the rotary gear 41A when the engagement is released. The cut gear 65A is not in mesh with the rotary gear 41A when the engagement arm 67 is engaged with the protrusion 66 such that the engagement is released. Cut gear 65A is in mesh with the rotary gear 41A only when it is fed by the coil spring 68.

A pair of cams 69 and 69 each having a large diameter portion is integrally provided with both ends (left end is inside the cut gear 65A) of the metallic shaft 65. In the state where the cleaning unit 41 is installed in the body casing 2, and the sheet carrier unit (belt unit) 35 is further installed, swing ends 61A and 61A of the pair of swing holding arms 61 and 61 are mounted on the circumferential surface of the pair of cams 69 and 69.

The operation of the pressure force adjusting mechanism 60 will be described referring to FIGS. 6 to 11 in addition to FIGS. 4 and 5. The pressure force adjusting mechanism corresponds with the driving unit that drives the cleaning mechanism (more specifically, the driving unit drives the backup roller 54 as a part of the cleaning mechanism) in accordance with the cleaning mode. FIG. 4 corresponding to FIGS. 6 and 9 represents the state where the large diameter portion of each cam 69 is directed upward, and the metallic shaft 65 is held with the engagement arm 67 at the rotary position where the cut gear portion of the cut gear 65A is not in mesh with the opposite rotary gear 41A.

Referring to FIGS. 6 and 9, in the aforementioned state, each swing end of the swing holding arms 61 and 61, at the left and right ends of the sheet carrier belt 38 mounted on the large diameter portion of the cam 69, is pushed upward against the urging force of the pressure spring 62. This places the backup roller 54 to the aforementioned remote position. In this case, the sheet carrier belt 38 is not in contact with both the cleaning roller 40 and the backup roller 54 where no cleaning pressure is generated. Even if the sheet carrier belt is brought into contact with the cleaning roller 40 that rotates counterclockwise as shown in the drawing, the cleaning operation is not performed as the cleaning pressure is not applied.

In the remote state shown in FIGS. 6 and 9, when the command signal for the cleaning operation is input to the solenoid 80, a displacement member 81 is pushed against the urging force of the coil spring 82 to rotate the rotary member 83. When the rotary member 83 rotates, its end portion rotates a rotary member 85 to displace the engagement arm 67. The rotary member 83 is rotatable around the conceptually shown axis K. The rotary member 85 is rotatable around the shaft 85A.

The aforementioned operation releases the engagement between the protrusion 66 and the engagement arm 67 as shown in FIG. 10. Accompanied with the disengagement, the metallic shaft 65 is urged by the coil spring 68 to rotate such that the cut gear 65A is in mesh with the rotary gear 41A, and driven to rotate. As the input of the signal to the solenoid 80 is stopped before the cut gear 65A rotates at a predetermined angle, the protrusion 66 is engaged with the engagement arm 67 again at the rotary position where the large diameter portion of each cam 69 is directed downward, and the cut gear portion of the cut gear 65A is not in mesh with the opposite rotary gear 41A. This brings the metallic shaft 65 to be held by the engagement arm 67 again. In the aforementioned state, the swing ends 61A and 61A of the swing holding arms 61 and 61 are pressed downward by the urging force of the pressure spring 62 to displace the backup roller 54 to the contact position. Then the sheet carrier belt 38 is brought into the contact between the backup roller 54 and the cleaning roller 40. Thereafter, the input of the command signal for the image forming operation to the solenoid 80 resumes the remote state as shown in FIGS. 6 and 9 again.

The pressure force adjusting mechanism 60 contacts the sheet carrier belt 38 between the backup roller 54 and the cleaning roller 40 only in the cleaning operation. In the image forming operation (for example, transfer of the image on the sheet 3 or fixation thereof), the sheet carrier belt 38 is positioned away from the backup roller 54 and the cleaning roller 40. This makes it possible to reduce the circulation load of the sheet carrier belt in the image forming operation to allow the sheet 3 to be stably carried. This also makes it possible to suppress deterioration in the cleaning roller 40 owing to its contact with the sheet carrier belt 38 kept under the pressure.

5. Detection of Installment of Cleaning Unit

Detection of installment of the cleaning unit 41 will be described.

Figure 14:
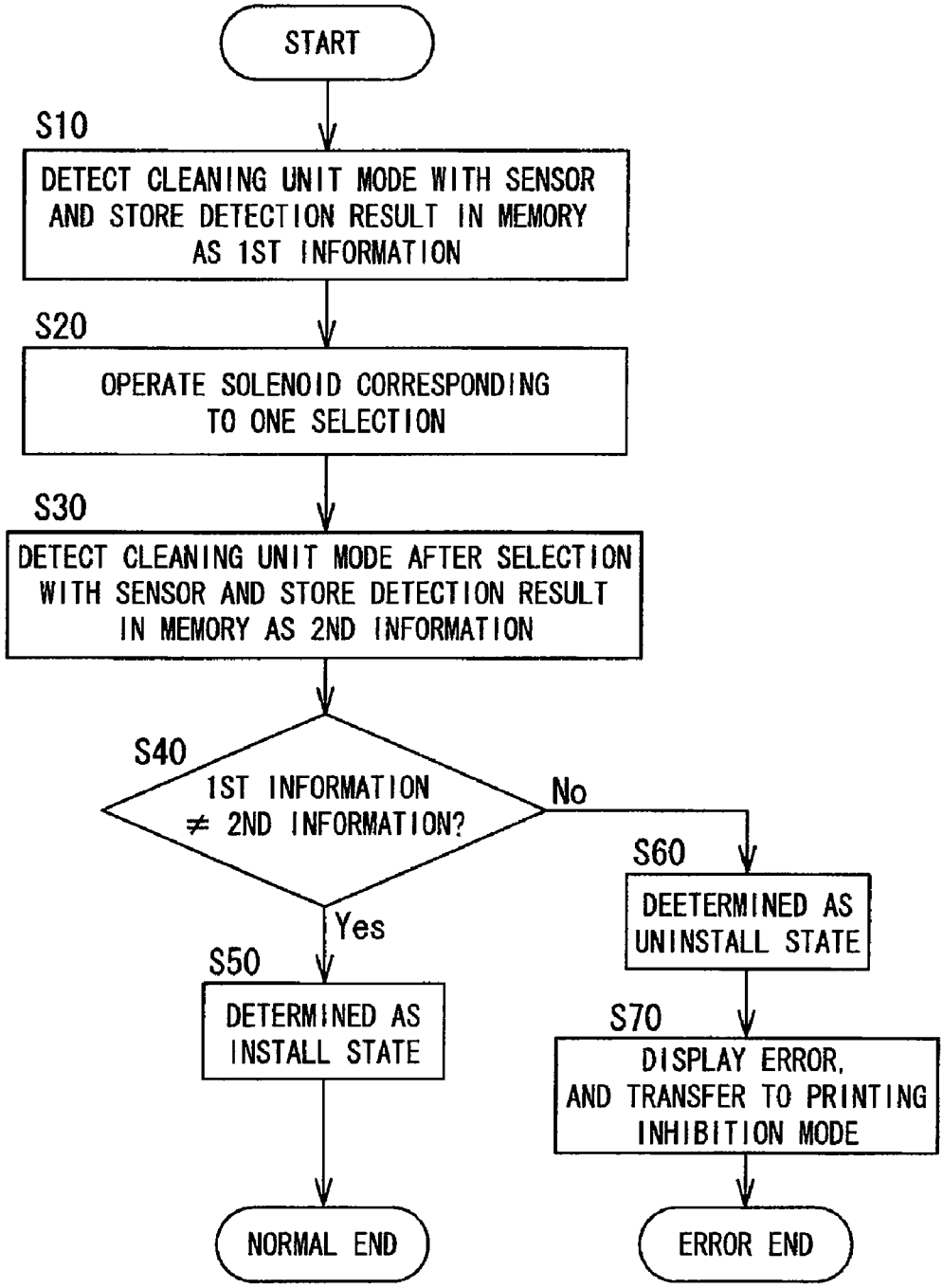
FIG. 14 is a flowchart of a control routine of the mode selection process according to the aspect shown in FIGS. 1 to 13.

FIG. 14 is a flowchart of the control routine for selecting the cleaning mode between a first mode (cleaning mode) and a second mode (non-cleaning mode). In this aspect of the present invention, a sensor 100 is provided as an operation state detection sensor for detecting an operation state of the cleaning mechanism. The sensor 100 is structured to detect the displacement of a swing member 103 as a target member to be detected of an interlock mechanism 110 (shown in FIG. 12) interlocked with the backup roller 54 as a part of the cleaning mechanism. In this aspect, the sensor 100 is formed of a photo-interrupter, but not limited thereto so long as it is capable of detecting the displacement.

FIGS. 12 and 13 are explanatory views for showing the operation of the interlock mechanism 110. An end portion 103A of the swing member 103 of the interlock mechanism 110 is structured to contact a protrusion 88 that protrudes in the axial radial direction of the metallic shaft 65 when a positional relationship is established. When the first mode for the cleaning operation is set, it displaces to a first position (see FIG. 13) where the protrusion 88 is not in contact with the end portion 103A, and thus the sensor 100 is unable to detect. When the second mode (as the non-cleaning mode) is set, the protrusion 88 contacts the end portion 103A to displace to a second position (at which the sensor 100 is able to detect end portion 103A as shown in FIG. 12). Referring to FIG. 12, when the second mode is set, the sensor 100 is brought into the state to detect the swing member 103. Referring to FIG. 13, when the first mode is set, the sensor 100 is brought into the non-detection state where the swing member 103 is not detected.

The installment state of the cleaning unit 41 is detected by the use of the interlock mechanism 110. Referring to FIG. 14, upon start of the mode selection process, the operation state of the cleaning mechanism is detected in S10. In S10, the sensor 100 confirms the current mode of the cleaning unit 41. If the sensor 100 detects the swing member 103, the value "2" is stored in a predetermined area of a memory (RAM93 or a not shown nonvolatile memory—hereinafter referred to as the RAM 93 and the like) If the sensor 100 does not detect the swing member 103, the value "1" is stored in a predetermined area of the memory (RAM 93 and the like). The information is defined as first information that represents the state before selection.

In the non-contact state before the cleaning operation, when the cleaning unit is normally installed, the sensor 100 will detect the swing member 103 as shown in FIG. 12. Based on the detection, the value "2" is stored in the memory. When the cleaning operation is intended to be performed, the swing member 103 is not detected as shown in FIG. 13, the value "1" is stored in the memory based on the non-detection state. When the cleaning unit 41 has not been installed, the detection data cannot be obtained. Accordingly, the value "1" is stored in the memory (RAM 93 and the like) likewise the first mode. If the value "2" is stored, it may be determined that the operation state is in the second mode. If the value "1" is stored, it may be determined that the operation state is in the first mode or the cleaning unit 41 is not installed.

After processing S10, a drive signal is output to an actuator of the cleaning unit 41 (specifically, solenoid 80) to operate the solenoid 80 in S20. The selection is performed as described above. If the cleaning unit 41 has been installed, the solenoid 80 is driven as shown in FIG. 10 to drive the cut gear 65A for bringing the backup roller 54 into the contact state as shown in FIGS. 8, 11 and 13.

The detection state of the sensor 100 is confirmed again. After operating the solenoid 80, the swing member 103 is brought into the state as shown in FIG. 13 accompanied with operations of the pressure force adjusting mechanism 60 so as not to allow the sensor 100 to perform the detection. Accordingly, when the cleaning unit 41 has been installed, the sensor 100 is in the non-detection state, and the value "1" is stored in the memory (RAM 93 and the like) in S30. Meanwhile, when the cleaning unit 41 has not been installed, the detection data cannot be obtained. Then the value "1" may be stored. The data in S30 is defined as the second information after selection.

In S40, the first information stored in the memory before selection is compared with the second information stored after the selection. If it is determined that they are different, Yes is obtained in S40. Then it is determined that the cleaning unit 41 has been already installed, and the determined state is stored in the memory. Meanwhile, if it is determined that the values are the same, No is obtained in S40 and the process proceeds to S60 where it is determined that the cleaning unit 41 has not been installed, and the determined state is stored in the memory. Then in S70, the error is displayed and printing is inhibited (the mode of the printer is set to printing inhibition mode). During the printing inhibition mode, the information that represents the printing inhibition mode is stored in a predetermined area of the memory (RAM 93 and the like). During the printing inhibition mode (when the information that represents the printing inhibition mode is stored in the predetermined area of the memory), the printing job may be cancelled through the processing executed by the CPU 91 even if the printing command is issued.

In this aspect, when the cleaning unit 41 has not been installed in the body casing 2, such state is alarmed on the display unit 99 (error display). The display unit 99 serves as the alarm unit. When the uninstall state of the cleaning unit 41 is determined, the image forming operation is inhibited. The CPU 91 corresponds with the inhibition unit.

Also, in this aspect, the cleaning mode of the cleaning mechanism including the cleaning roller 40 (cleaning member) and the backup roller 54 (backup member) having the roller surface that abuts the carrier belt 38 is selectable between the first mode that enhances the cleaning performance and the second mode that lowers the cleaning performance compared with the first mode. The CPU 91 corresponds with the mode setting unit.

Based on the cleaning mode set by the CPU 91 and the detection result of the sensor 100 (operation state detection sensor), it is determined whether the cleaning unit 41 has been installed in the body casing 2. More specifically, based on the cleaning mode to be set and the displacement of the target unit subjected to the detection of the sensor 100 (operation state detection sensor), it is determined whether the cleaning unit 41 has been installed in the body casing 2. The CPU 91 serves as the determination unit that makes the aforementioned determinations.

More specifically, in the state where the cleaning unit 41 is installed, the cleaning mechanism is structured to be driven by the pressure force adjusting mechanism 60 (drive unit)

such that it is brought into the first operation state when the first mode is set, and brought into the second operation state when the second mode is set. The sensor 100 is structured to output the detection signal in accordance with the operation state of the cleaning mechanism as shown in FIGS. 12 and 13. The CPU 91 determines that the cleaning unit 41 has not been installed in the body casing 2 when the detection signal from the sensor 100 is the invalid signal that indicates the operation state which does not conform to the cleaning mode to be set (the second information which should be different from the first information, through mode selection, becomes the same as the first information).

The backup roller 54 that forms a part of the cleaning mechanism is structured to move between a contact position where the carrier belt 38 is in contact between the backup roller 54 and the cleaning roller 40, and the non-contact position where the carrier belt 38 is positioned away from the backup roller 54. The pressure force adjusting mechanism 60 is structured to move the backup roller 54 to the contact position (FIG. 11) when the cleaning mode is set to the first mode, and to be moved to the non-contact position (FIG. 9) when the cleaning mode is set to the second mode. The first mode can include or be herein referred to a first cleaning force or effect, and the second mode can include or be herein referred to the second cleaning force or effect. The sensor 100 outputs the position signal in accordance with the position of the backup roller 54. In the process shown in the flowchart of FIG. 14, it is determined whether the cleaning unit 41 has been installed in the body casing 2 based on the set cleaning mode and the position signal output from the sensor 100.

Another aspect of the present invention will be described referring to FIG. 15.

This aspect is substantially the same as the one shown in FIGS. 1 to 14 except the flow of the mode selection process. Accordingly, it is assumed that the structure shown in FIGS. 1 to 13 is used in this aspect.

Figure 15:
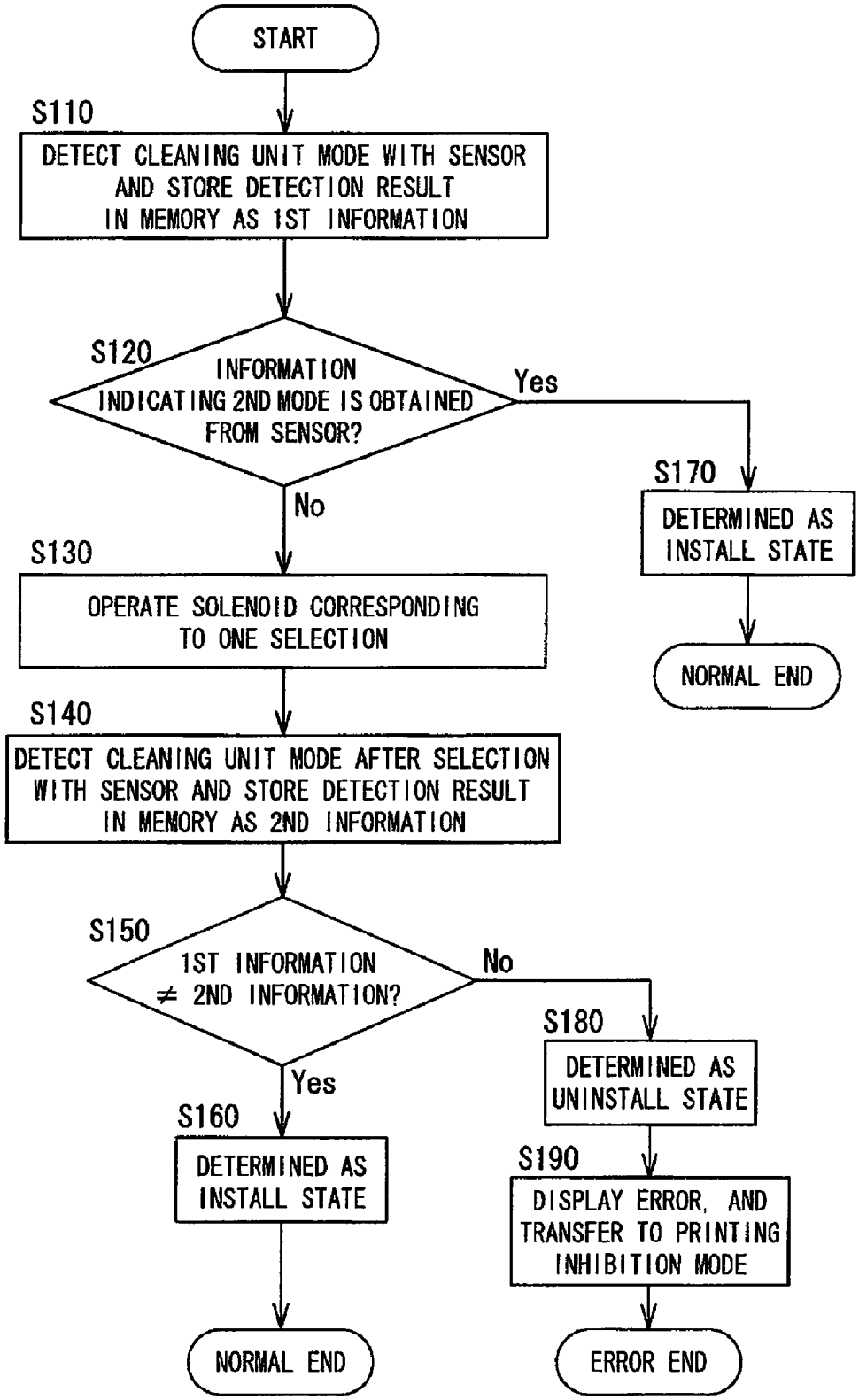
FIG. 15 is a flowchart showing an exemplary mode selection process according to another aspect of the present invention.

In the aspect shown in FIG. 15, the second mode (where the cleaning is not performed) is defined as a confirmation mode for confirming the operation state of the cleaning mechanism. The sensor 100 is structured to output the operation detection signal upon establishment of the condition that cleaning unit 41 has been installed, and the operation state of the cleaning mechanism corresponds with the confirmation mode. In the case where the sensor 100 outputs the operation detection signal in response to setting of the confirmation mode (the second mode), it is determined that the cleaning unit 41 has been installed.

More specifically, referring to the flowchart of FIG. 15, in S110, the mode of the cleaning unit 41 is confirmed by the sensor 100, and the confirmed result is stored in the memory as the first information. In this aspect, the swing member 103 of the interlock mechanism 110 interlocked with the backup roller 54 is set as the target unit to be subjected to the detection. The sensor 100 detects the displacement of the swing member 103.

In the case where the cleaning unit 41 is installed and the second mode (confirmation mode) is set, the swing member 103 is brought into the state as shown in FIG. 12 so as to be detected such that the sensor 100 outputs the operation detection signal (signal indicating the detection of the swing member 103). If the operation detection signal from the sensor 100 is confirmed, Yes is obtained in S120, and in S170 it is determined that the cleaning unit 41 has been already installed. When the operation detection signal cannot be confirmed, No is obtained in S120, and in S130 the solenoid 80 is operated.

The sensor 100 confirms the mode of the cleaning unit 41, and the confirmed result is stored in the memory as the second information. If the second information from the sensor 100 is different from the first information, it is determined that the cleaning unit 41 has been installed in S160. If the second information from the sensor 100 is the same as the first information stored in the memory, No is obtained in S150. In S180, it is determined that the cleaning unit 41 has not been installed to display the error and to set the printing inhibition mode in S190.

Referring to FIGS. 16 to 31, another aspect of the present invention will be described.

Figure 16:
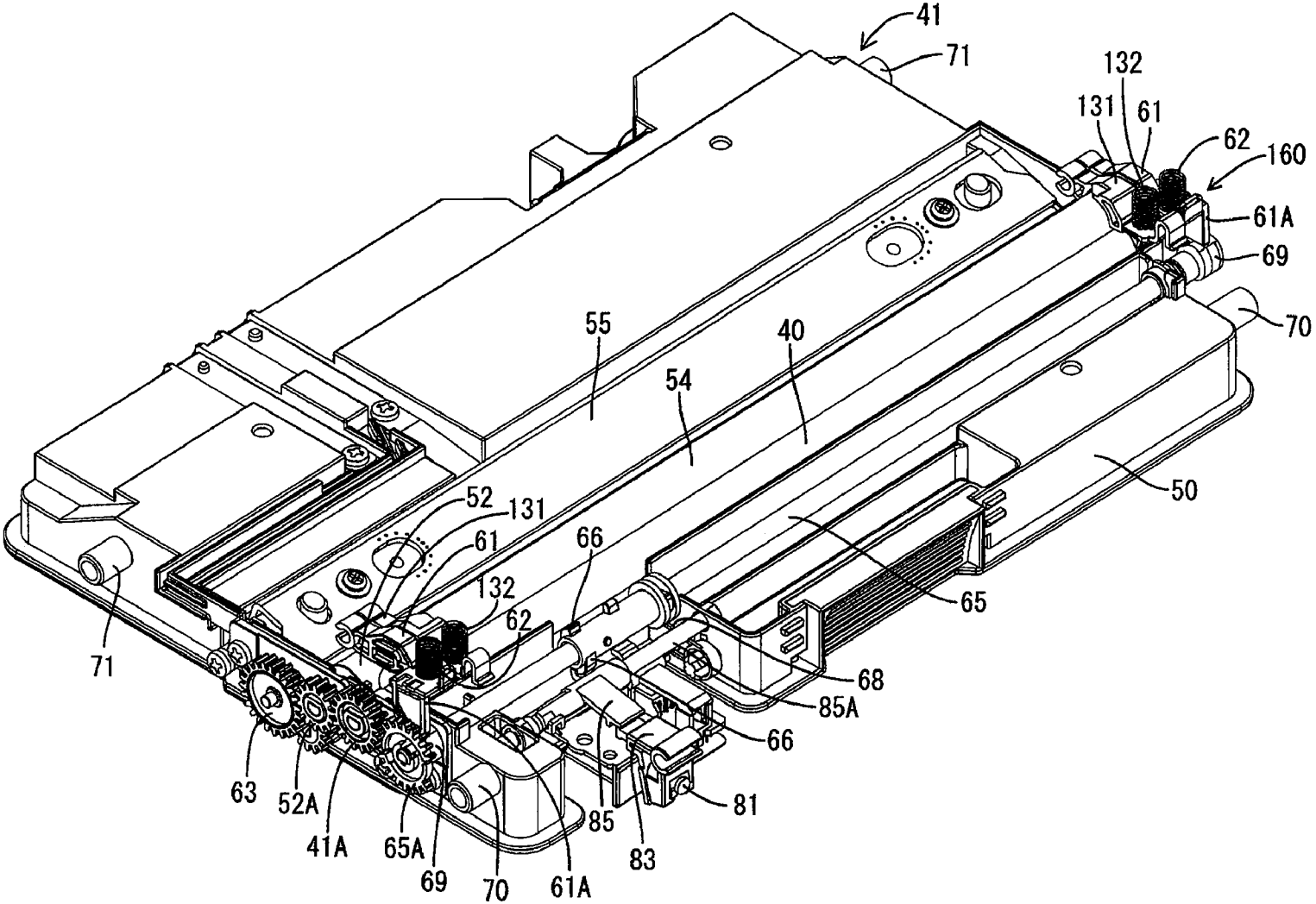
FIG. 16 is a perspective view showing a cleaning unit 41 and a pressure force adjusting mechanism 160 according to another aspect of the present invention.
Figure 17:
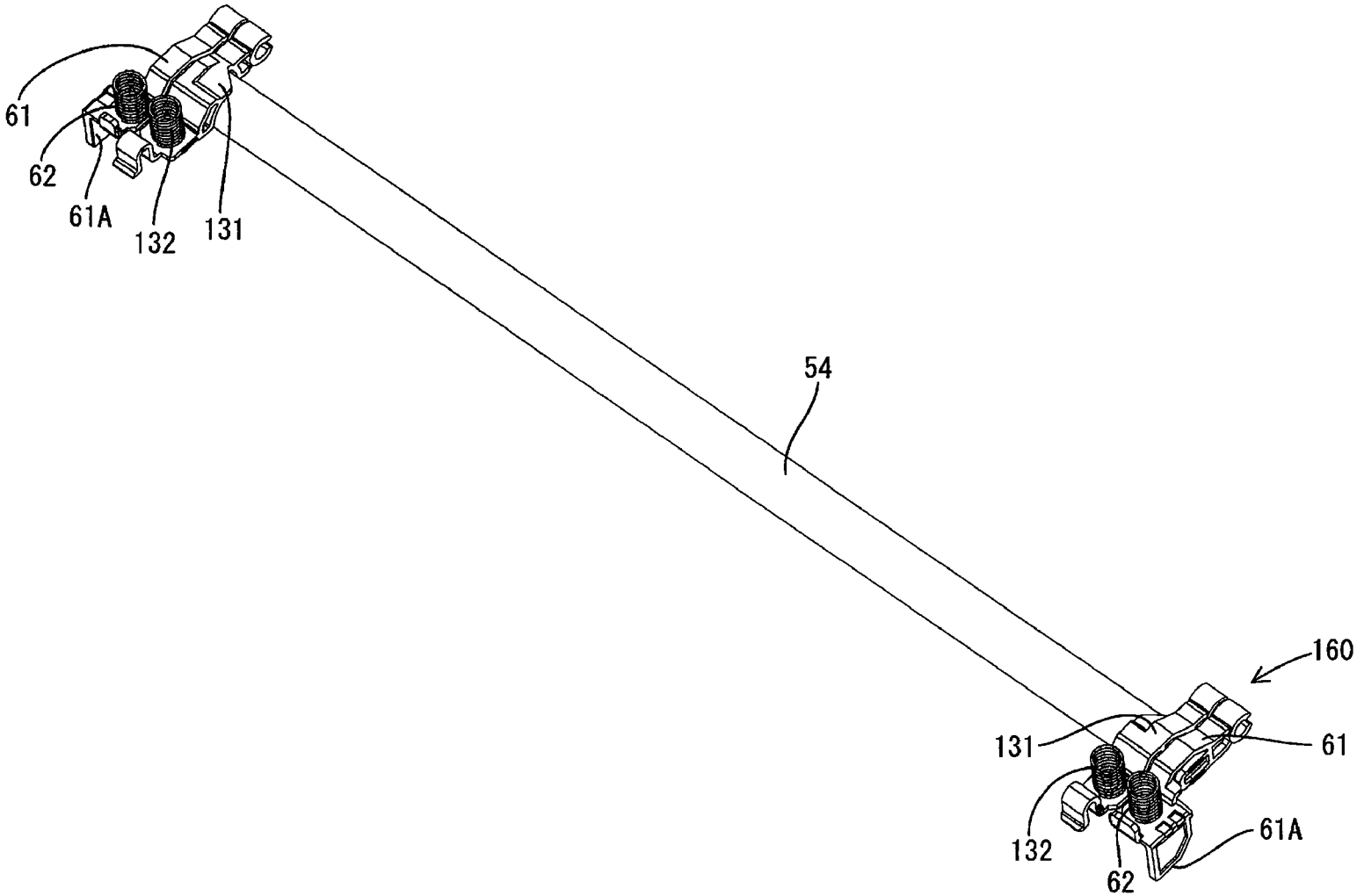
FIG. 17 is a perspective view showing a correlation between the arms 61 and 61, the arms 131 and 131, and the backup roller 54 according to the aspect shown in FIG. 16.
Figure 18:
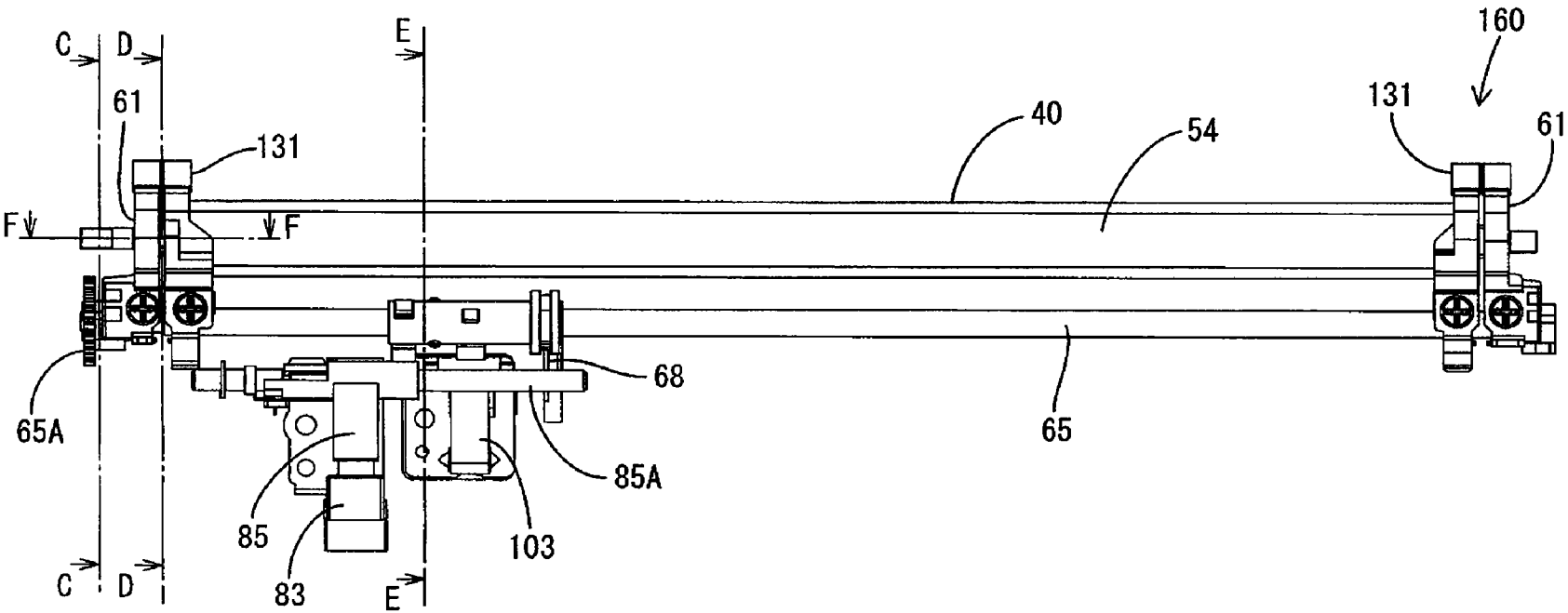
FIG. 18 is a top view of the structure around the pressure force adjusting mechanism 160 and the backup roller 54 according to the aspect shown in FIG. 16.
Figure 19:
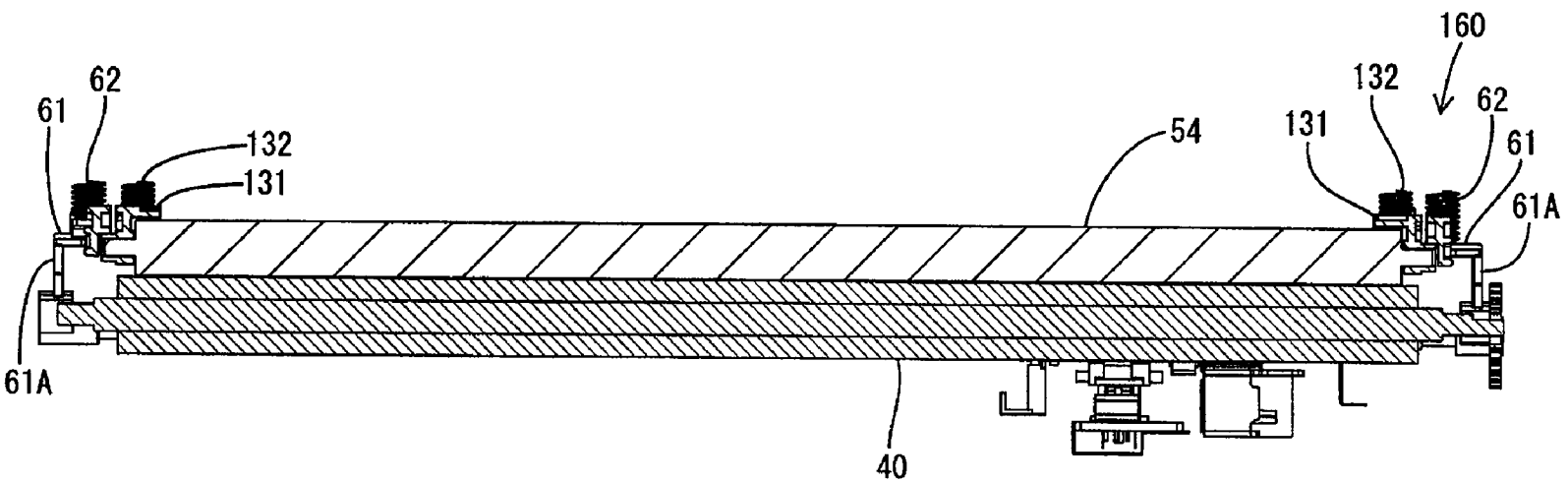
FIG. 19 is a view schematically showing the cross section of the view according to the aspect shown in FIG. 16, which is cut along the axes of the backup roller 54 and the cleaning roller 40.
Figure 20:
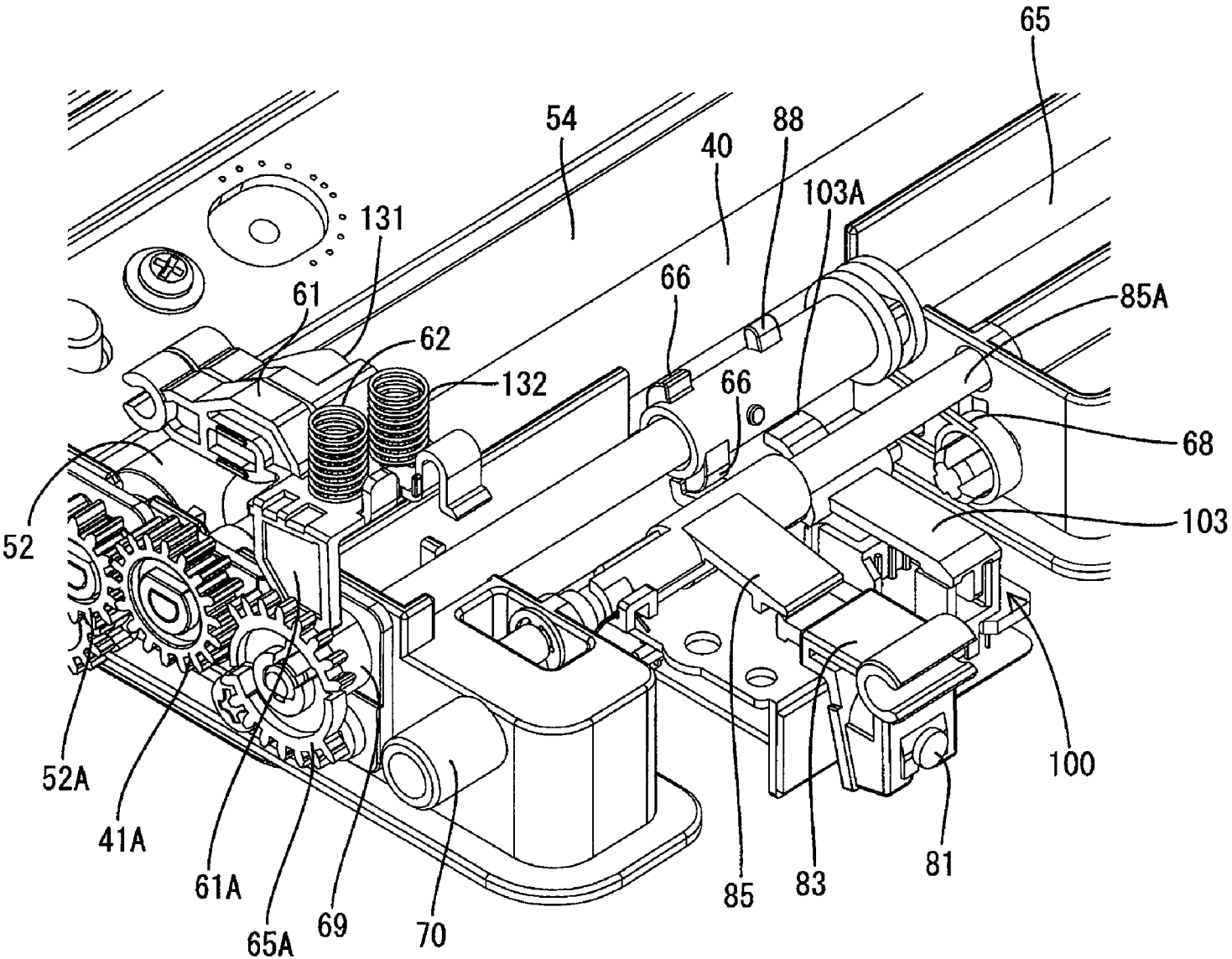
FIG. 20 is a perspective enlarged view of a portion of the pressure force adjusting mechanism 160 according to the aspect shown in FIG. 16.
Figure 21:
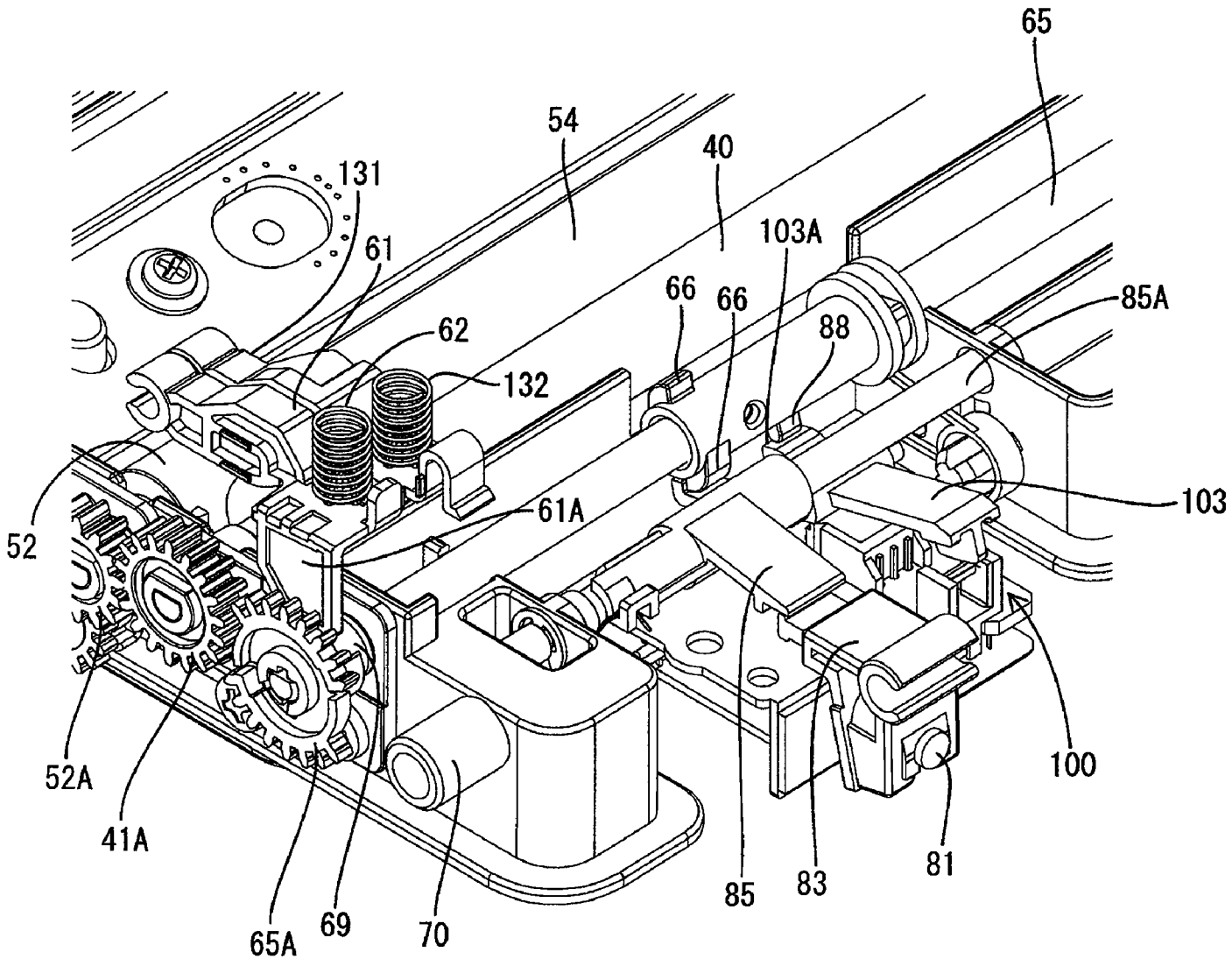
FIG. 21 shows the state where the first mode has been selected from the state shown in FIG. 20.
Figure 22:
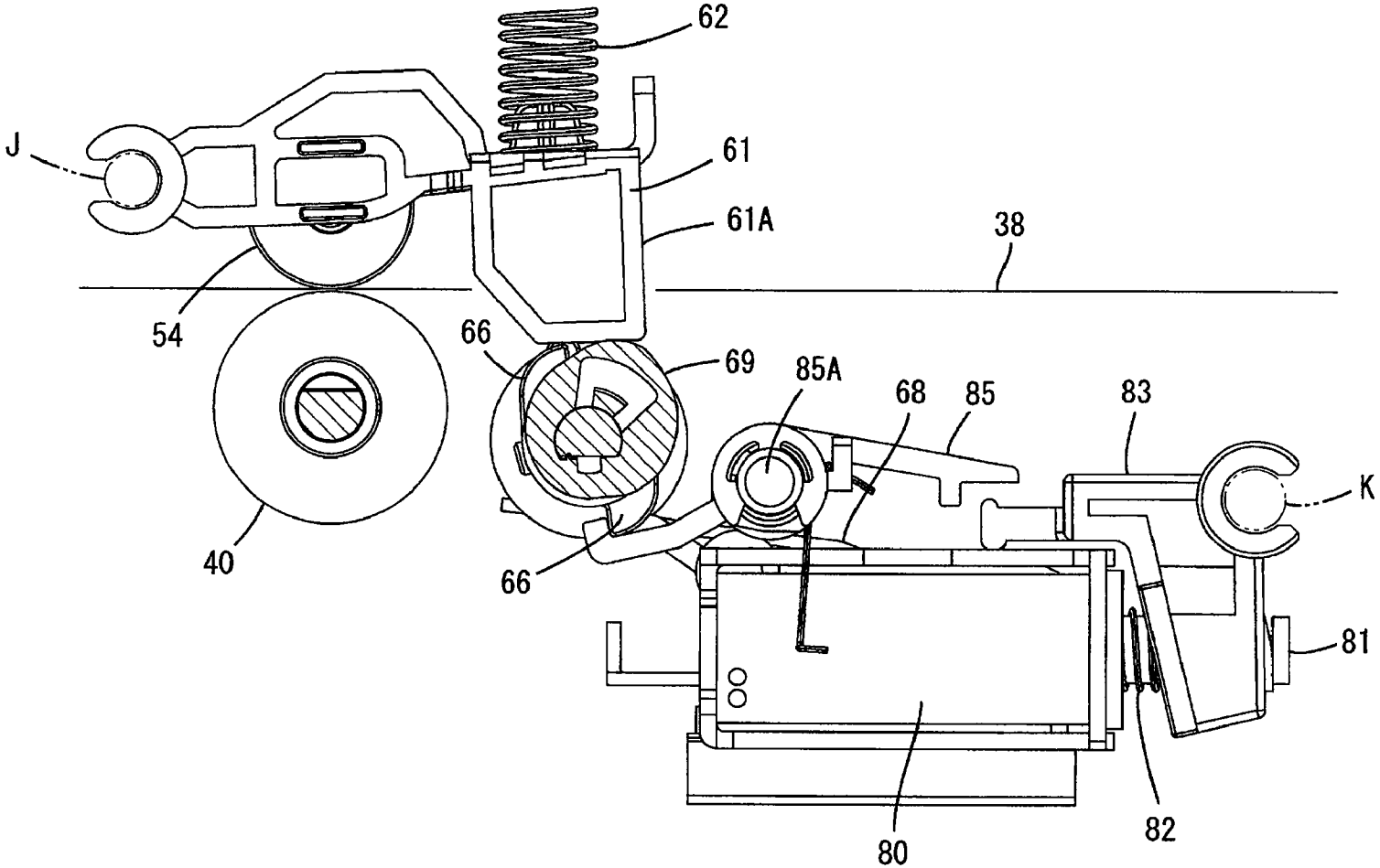
FIG. 22 is a sectional view taken along line C-C of FIG. 18 schematically showing the state where the second mode has been set.
Figure 23:
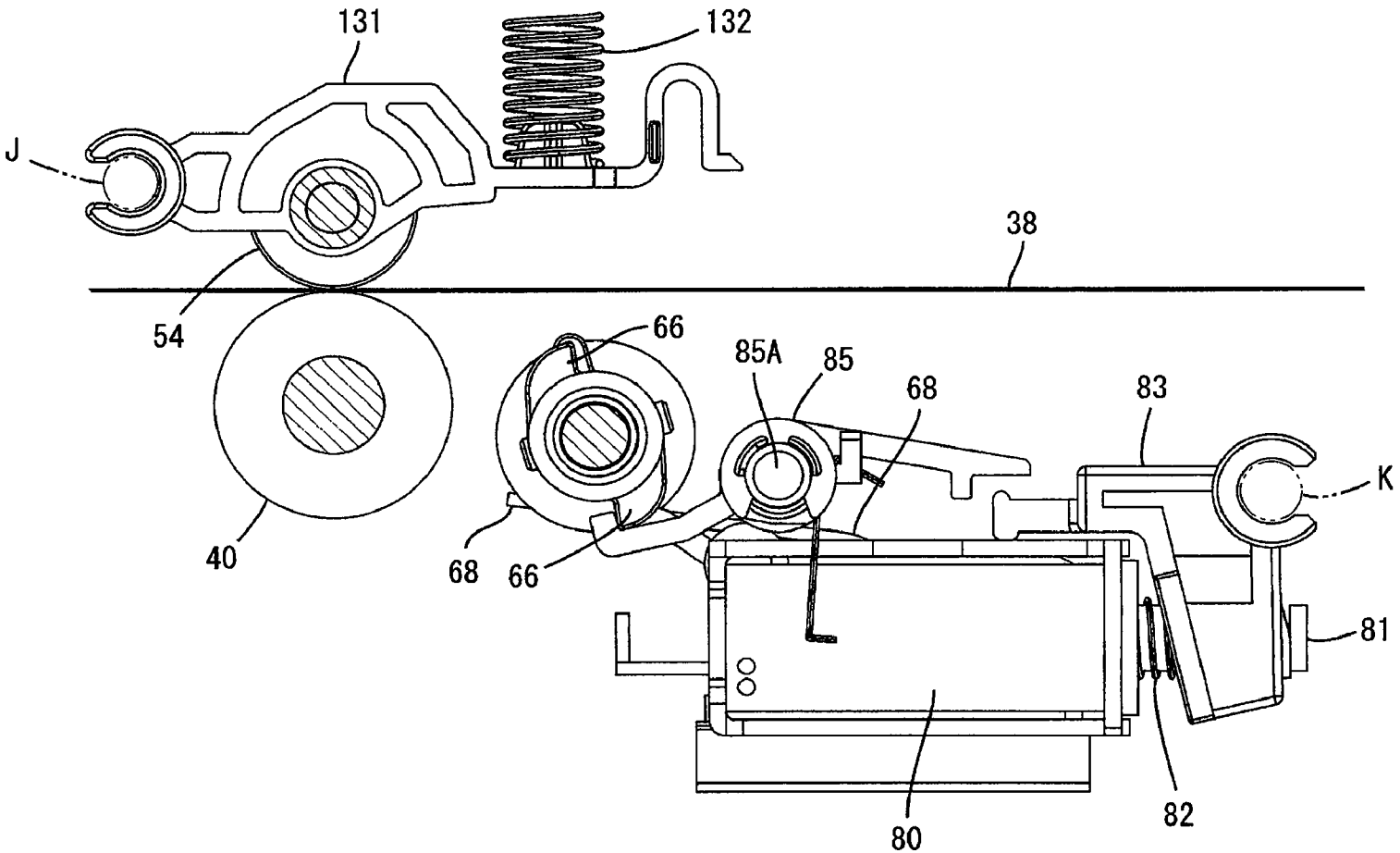
FIG. 23 is a sectional view taken along line D-D of FIG. 18 schematically showing the state where the second mode has been set.
Figure 24:
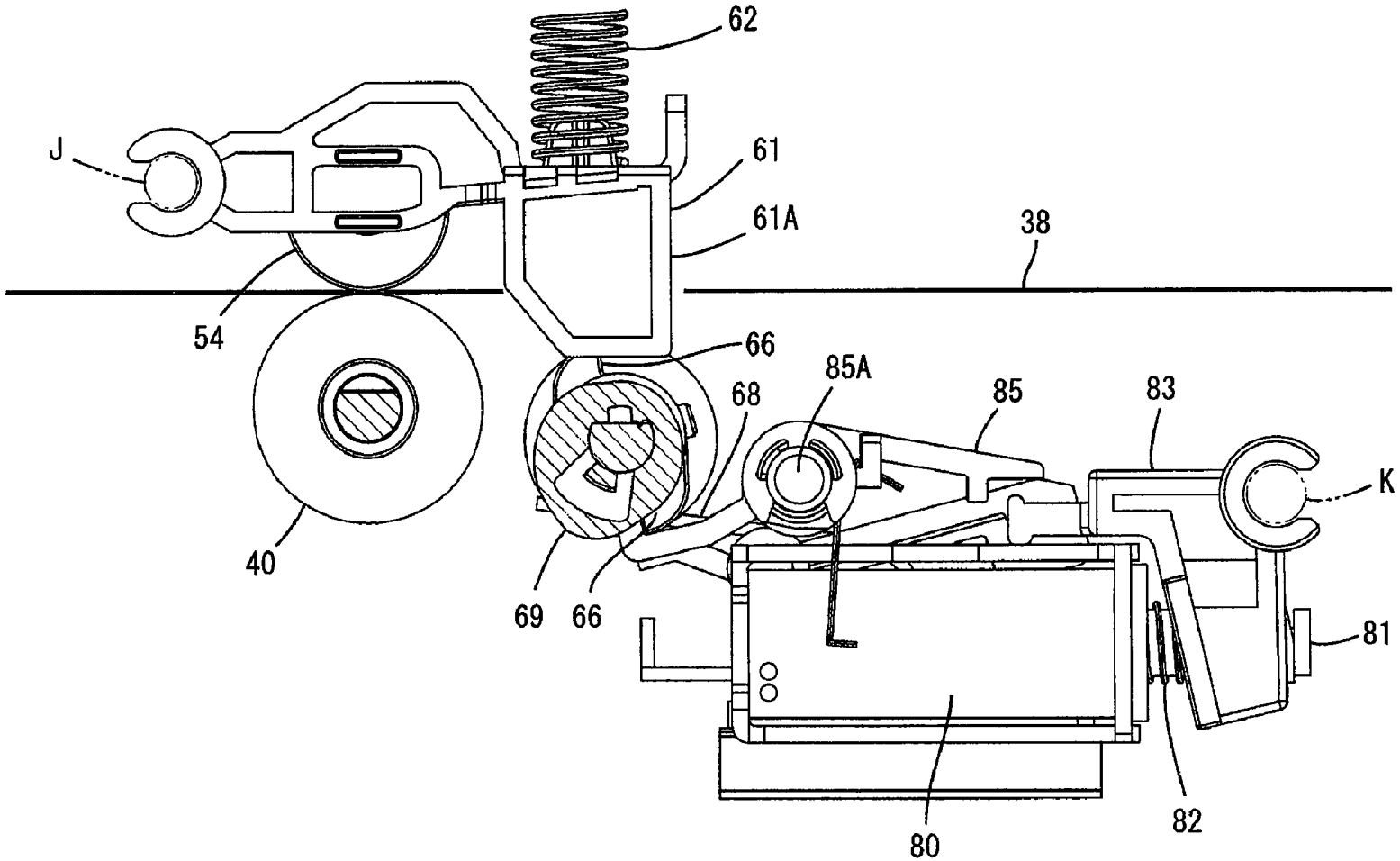
FIG. 24 shows the state where the first mode has been selected from the state shown in FIG. 22.
Figure 25:
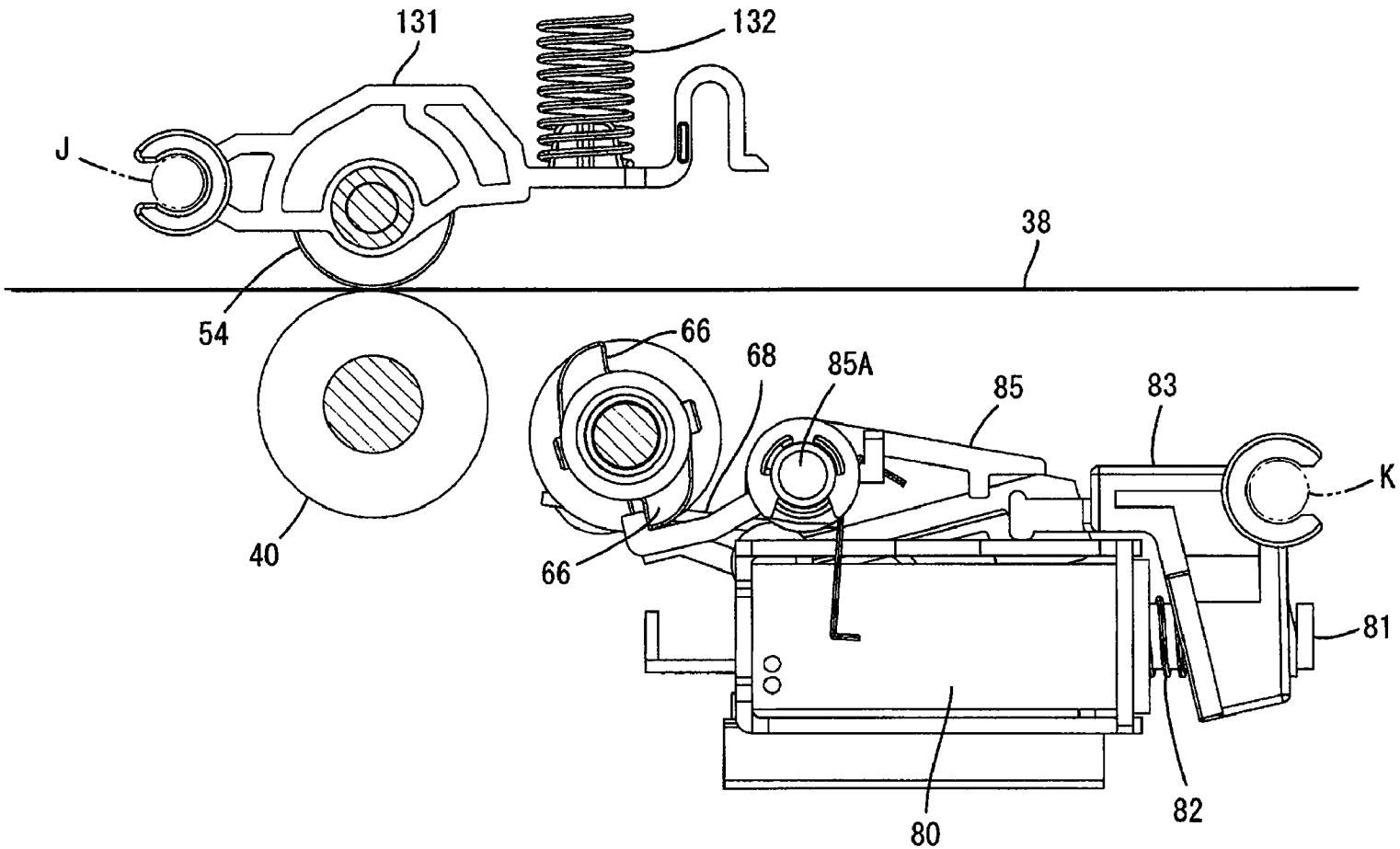
FIG. 25 shows the state where the first mode has been selected from the state shown in FIG. 23.
Figure 26:
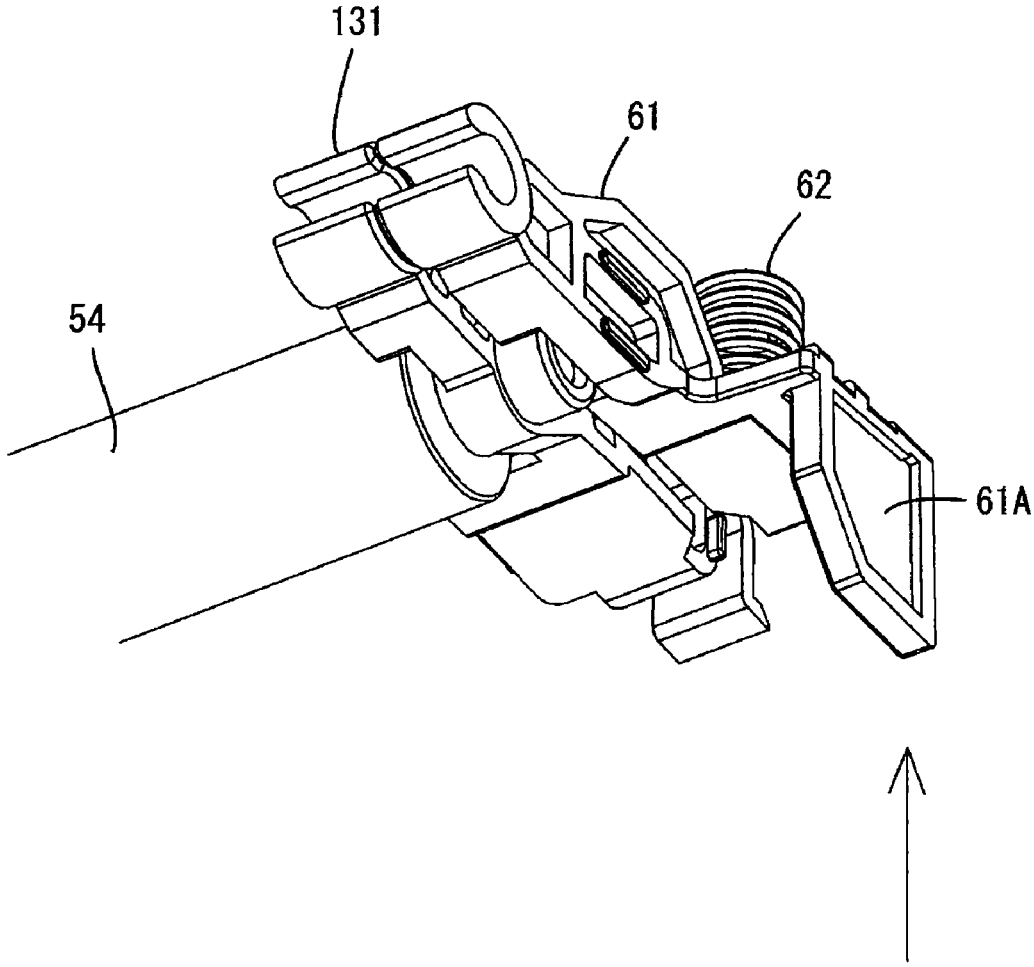
FIG. 26 is a perspective view representing the structure to support the backup roller 54 with the arms 61 and 131 in the second mode.
Figure 27:
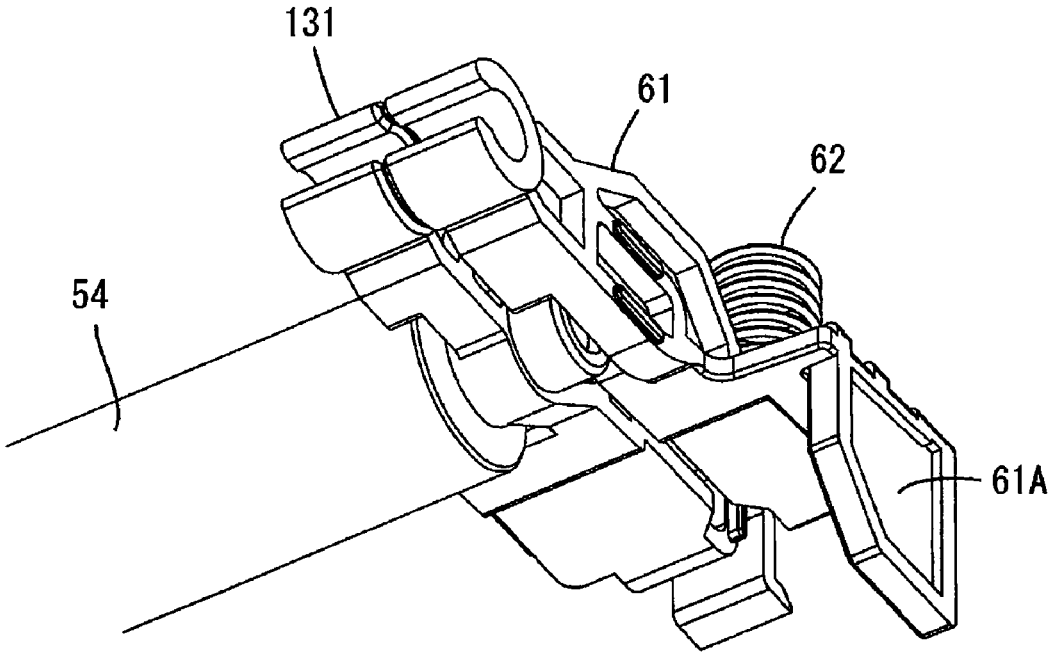
FIG. 27 shows the state where the first mode has been selected from the state shown in FIG. 26.
Figure 28:
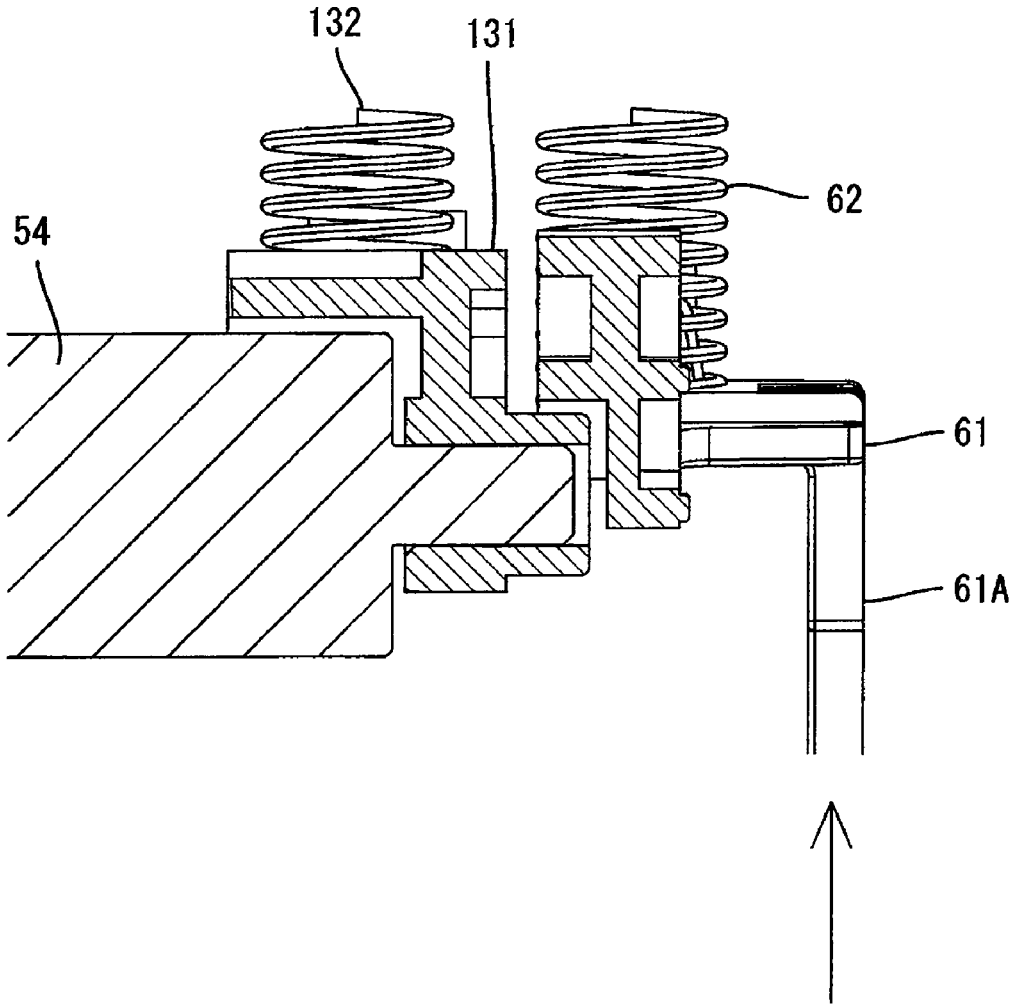
FIG. 28 is a sectional view taken along line F-F of FIG. 18 schematically showing the state of the second mode.
Figure 29:
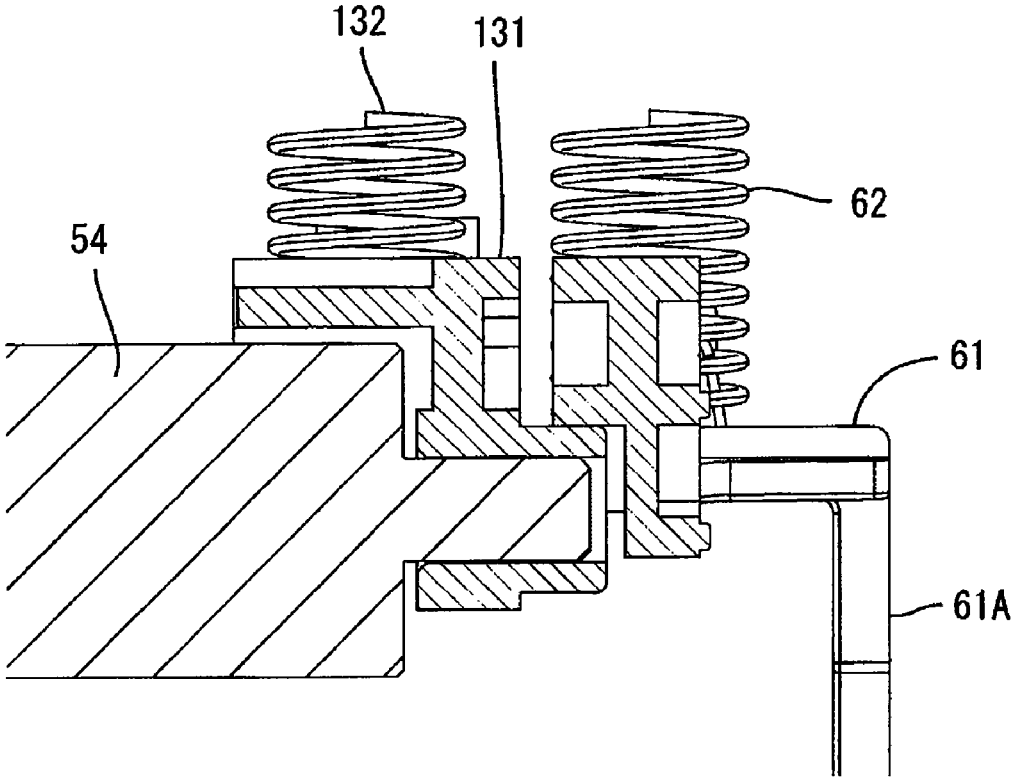
FIG. 29 shows the state where the first mode has been selected from the state shown in FIG. 28.
Figure 30:
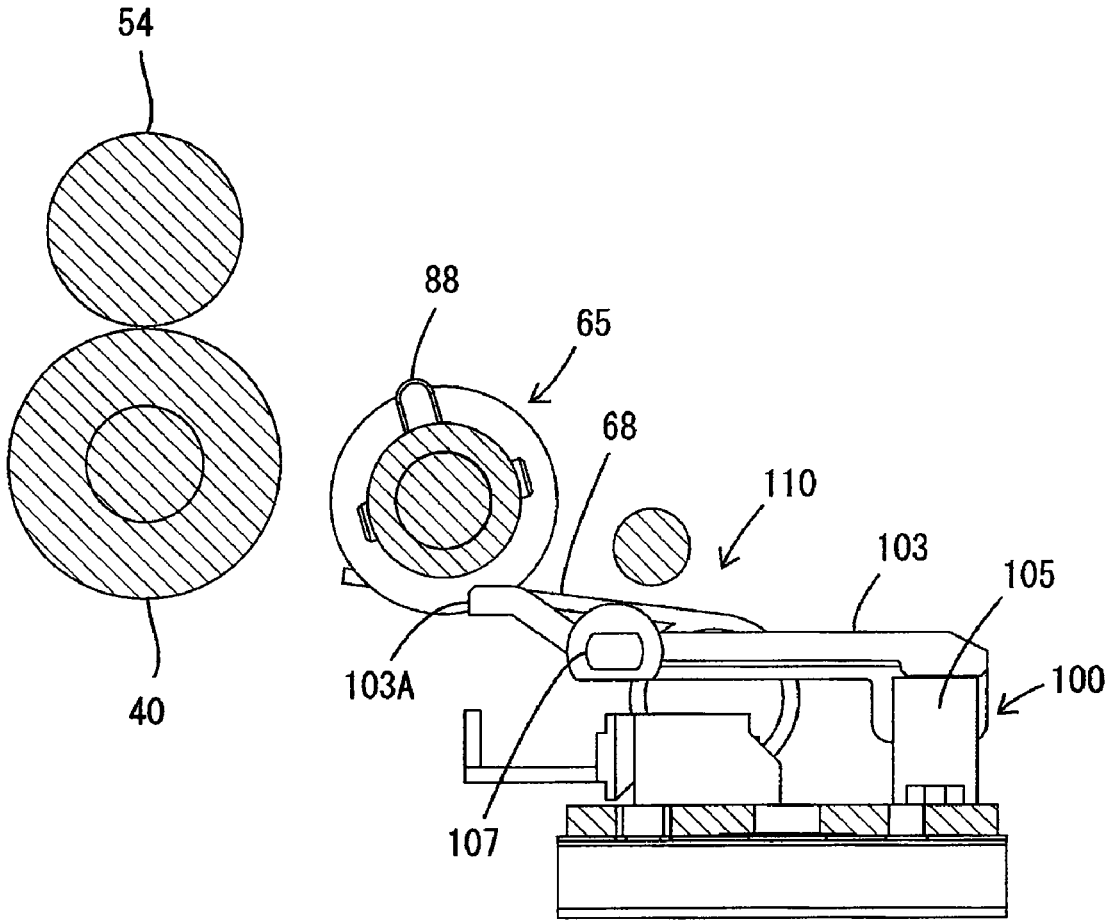
FIG. 30 is a sectional view taken along line E-E of FIG. 9 conceptually showing the structure around the interlock mechanism 110 and the sensor 100.
Figure 31:
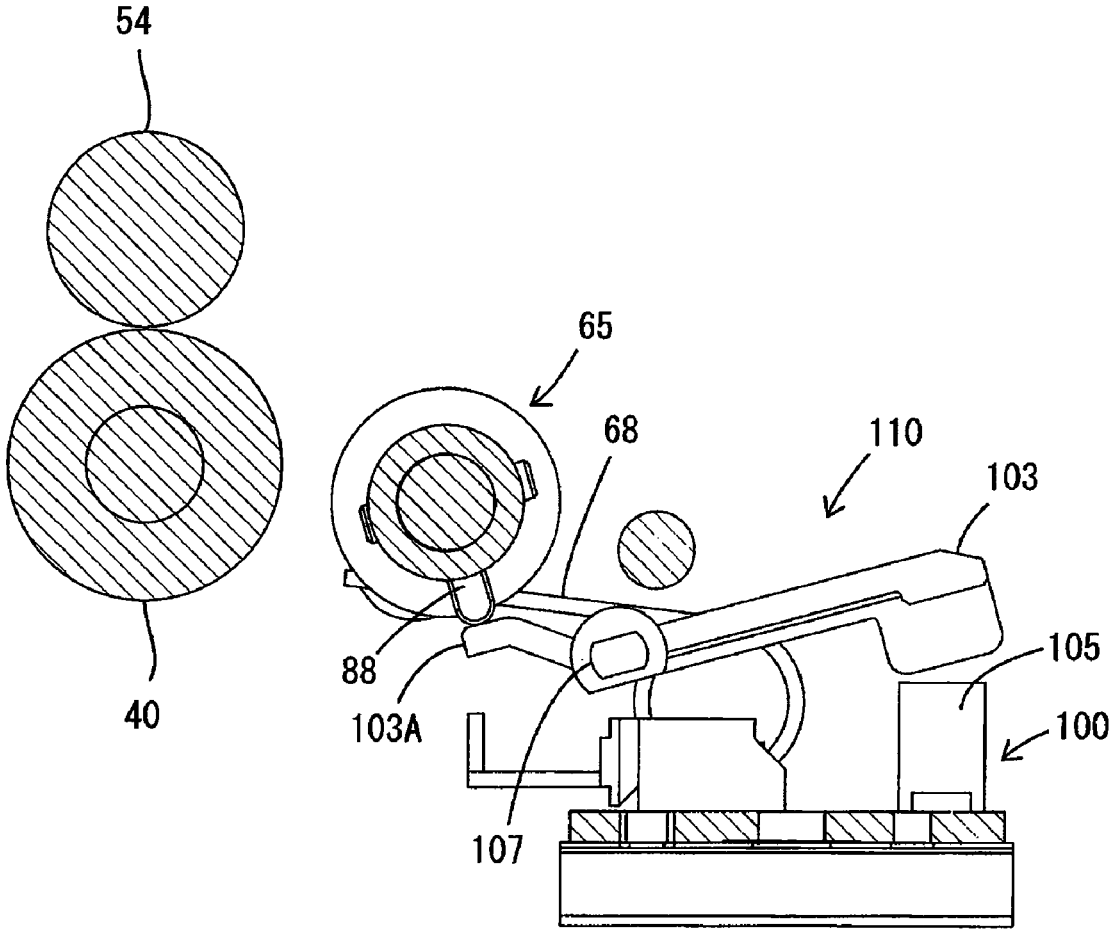
FIG. 31 shows the state where the first mode has been selected from the state shown in FIG. 30.

FIG. 16 is a perspective view showing a cleaning unit 41 and a pressure force adjusting mechanism 160. FIG. 17 is a perspective view showing a correlation between the arms 61, 61 and the arms 131, 131, and the backup roller 54. FIG. 18 is a top view of the structure around the pressure force adjusting mechanism 160 and the backup roller 54. FIG. 19 is a view schematically showing the cross section of the view which is cut along the axes of the backup roller 54 and the cleaning roller 40. FIG. 20 is a perspective enlarged view of a portion of the pressure force adjusting mechanism 160. FIG. 21 shows the state where the first mode has been selected from the state shown in FIG. 20. FIG. 22 is a sectional view taken along line C-C of FIG. 18 schematically showing the state where the second mode has been set. FIG. 23 is a sectional view taken along line D-D of FIG. 18 schematically showing the state where the second mode has been set. FIG. 24 shows the state where the first mode has been selected from the state shown in FIG. 22. FIG. 25 shows the state where the first mode has been selected from the state shown in FIG. 23. FIG. 26 is a perspective view representing the structure to support the backup roller 54 with the arms 61 and 131 in the second mode. FIG. 27 shows the state where the first mode has been selected from the state shown in FIG. 26. FIG. 28 is a sectional view taken along line F-F of FIG. 18 schematically showing the state of the second mode. FIG. 29 shows the state of the view where the first mode has been selected from the state shown in FIG. 28. FIG. 30 is a sectional view taken along line E-E of FIG. 18 schematically showing the structure around the interlock mechanism 110 and the sensor 100. FIG. 31 shows the state where the first mode has been selected from the state shown in FIG. 30.

In this aspect, the cleaning roller 40 (serving as the cleaning member which is the same as the one in the aspect shown in FIGS. 1 to 14), and the backup roller 54 as the backup member are provided as the cleaning mechanism. The structure of the present aspect is the same as that of the aspect shown in FIGS. 1 to 14 except that the pressure force adjusting mechanism 160 has the structure different from that of the pressure force adjusting mechanism 60 in the aspect shown in FIGS. 1 to 14. Accordingly, the same components will be designated with the same reference numerals, and detailed explanations thereof, thus, will be omitted. Specifically, the pressure force adjusting mechanism 160 is different from the one in the aspect shown in FIGS. 1 to 14 in that the pressure mechanism is provided to press the backup roller 54 even in the second mode (in the non-cleaning operation). The pressure mechanism is formed of a pair of arms 131, 131 and a pair of coil springs 132, 132 for urging arms 131, 131 as shown in FIGS. 17 to 19. Referring to FIGS. 19, 28 and 29, the backup roller 54 is rotatably supported with the arms 131 and 131 instead of the arms 61 and 61.

In this aspect, when the first mode is set (see FIGS. 21, 24, 27 and 29 to be described later), the backup roller 54 is urged by the coil springs 62, 62, and 132, 132. When the second mode is set (see FIGS. 20, 22, 26 and 28 to be described later), backup roller 54 is urged only by the coil springs 132, 132. Accordingly, in the first mode, the backup roller 54 is brought into contact with the cleaning roller 40 under the strong force. Meanwhile in the second mode, it is brought into contact with the cleaning roller 40 under a force less than the aforementioned strong force.

When the first mode is set by the CPU 91 serving as the mode set unit, the backup roller 54 comes into a first pressure state with the carrier belt 38. The first pressure state can be herein referred to the first cleaning force or effect. When the second mode is set, the backup roller 54 comes into a second pressure state where a pressure force applied to the carrier belt 38 is lower than the first pressure state. The second pressure state can be herein referred to the second cleaning force or effect. The sensor 100 corresponding to the operation state detection sensor has the same structure as that of the aspect shown in FIGS. 1 to 14 for outputting the state signal in accordance with the pressure state of the backup roller 54. The CPU 91 determines whether the cleaning unit 41 has been installed in the body casing 2 based on the cleaning mode set and the state signal (signal indicating detection or non-detection) from the sensor 100.

In this aspect, as the structure of the portion below the carrier belt 38 is the same as that of the aspect shown in FIGS. 1 to 14, the detailed explanation of the structure will be omitted. Referring to FIGS. 20, 22, 26 and 28, when the second mode is set, the large diameter portion of each of the cams 69 is directed upward to press the swing ends 61A and 61A upward (see arrow shown in FIGS. 26 and 28) similar to that shown in FIGS. 1 to 14. The force of the arms 61 and 61, that is, the force derived from the coil spring 62, is not transferred to the arms 131 and 131 as shown in FIGS. 25 and 28. Accordingly, the backup roller 54 is urged against the carrier belt 38 only by the coil springs 132 and 132 as shown in FIGS. 20, 23 and 28. When the first mode is selected, the solenoid 80, rotary members 83 and 85, the metallic shaft 65, the coil spring 68 and the cut gear 65A are driven similar to that shown in FIGS. 1 to 14, and the large diameter portion of the cam 69 is directed downward (as shown in FIGS. 21, 24, 27 and 29). In this case, as the swing ends 61A, 61A are movable downward, the force applied by the coil spring 62 is transferred to the arms 131 and 131 as shown in FIGS. 24, 27 and 29. Then the urging forces of both the coil springs 62 and 132 may be applied to the backup roller 54 supported with the arms 131 and 131. The backup roller 54, thus, is brought into contact with the carrier belt 38 under a force stronger than that applied in the second mode.

Referring to FIGS. 30 and 31, the interlock mechanism 110 has the same structure as that of the aspect shown in FIGS. 1 to 14. In the second mode, the sensor 100 detects the swing member 103 as shown in FIG. 30. Meanwhile, in the first mode, the metallic shaft 65 rotates to cause the protrusion 88 to act on the end portion 103A such that the sensor 100 fails to detect the swing member 103 as shown in FIG. 31. As the interlock mechanism 110 is the same as that of the aspect shown in FIGS. 1 to 14, the flow of the mode selection process is regarded as being the same as that of the aspect shown in FIG. 14. That is, in this aspect, the mode selection process is performed in the same manner as in FIG. 14. When the first information, before the mode selection to be stored in the memory, is different from the second information after the selection, it is determined that the cleaning unit 41 has been installed. When the first information before selection is the same as the second information after selection, it is determined that the cleaning unit 41 has not been installed. This makes it possible to the uninstall state of the cleaning unit 41.

Figure 32:
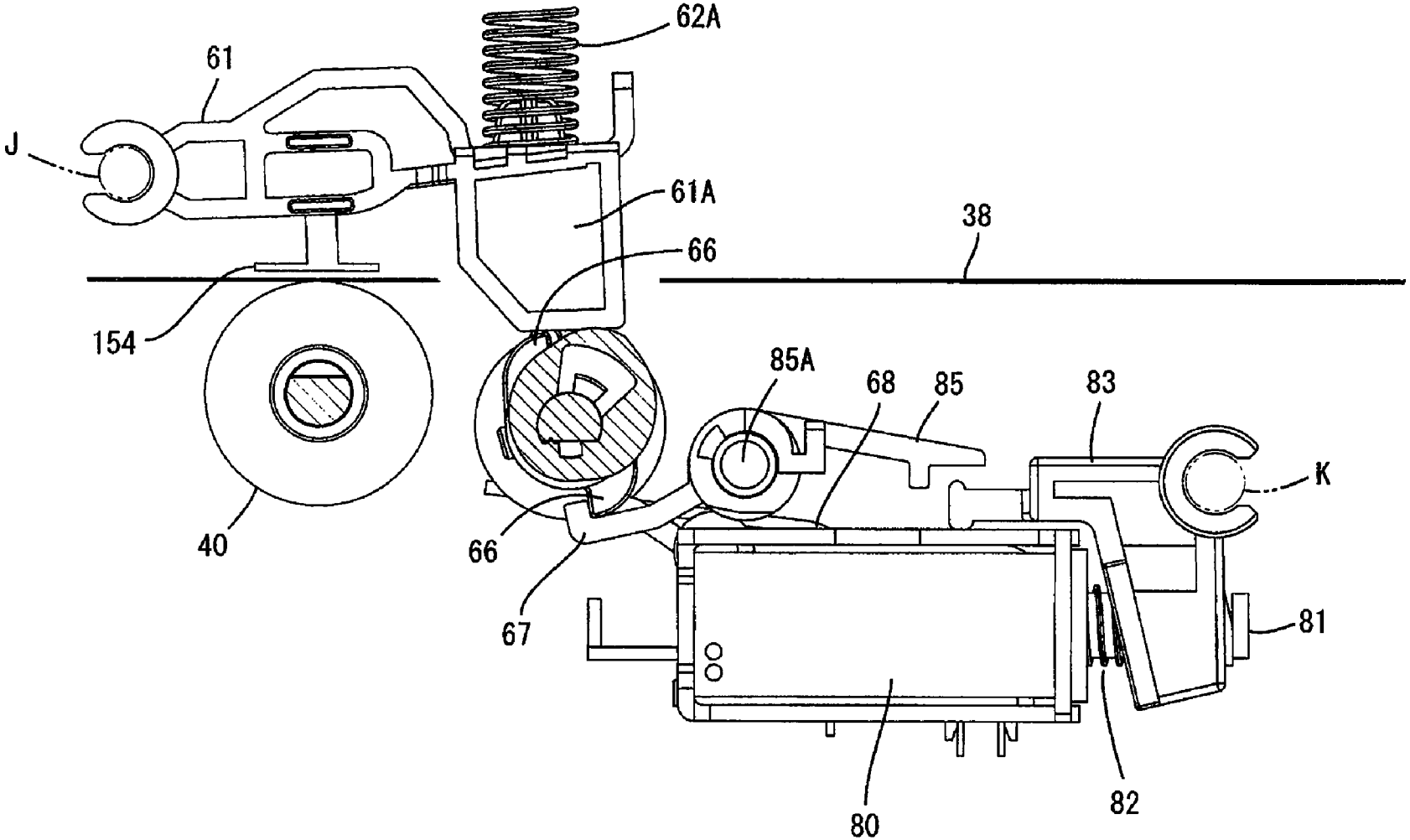
FIG. 32 is a view formed by modifying the view in FIG. 9, conceptually representing the pressure force adjusting mechanism according to another aspect of the present invention.

Another aspect of the present invention will be described referring to FIG. 32.

In the aspects shown in FIGS. 1 to 31, the backup roller 54 is formed as the backup member. In the present aspect, a backup plate 154 (having a plate surface which abuts the carrier belt 38) is formed as the backup member. The structure shown in FIG. 32 is obtained by changing only the backup member of the structure shown in FIG. 9. In this aspect, the same structure as that of the aspect shown in FIGS. 1 to 14 applies to this aspects structure, except for the aforementioned backup member. It is to be understood that the backup roller 54 may be replaced with the backup plate in any of the aspects of the invention.

Another aspect of the present invention will be described referring to FIGS. 33 and 34.

The structure of this aspect is the same as that of the aspect shown in FIGS. 1 to 14 except for the cleaning roller 40, the motor M, and the sensor 200 of the cleaning unit 41. The explanation will be made referring to FIGS. 33 and 34 on the assumption that the aspect has the same structure as that of the one shown in FIGS. 1 to 14 except the aforementioned components. FIG. 33 is an explanatory view conceptually representing the cleaning unit 41 and the structure there around in the state where the first mode has been set. FIG. 34 shows the state where the second mode has been selected from the state shown in FIG. 33.

This aspect shows an example in which the cleaning roller is structured to be movable close to or remote from the carrier belt 38. The motor M can be a stepping motor, and the like. The motor M and the interlock mechanism interlocked with the motor M (for example, adjusting mechanism that adjusts the rotation of the motor into the linear operation) drive the bearing portion 40A of the cleaning roller 40 to displace the cleaning roller 40. In the CPU 91 shown in FIG. 2, when the first mode is set, the motor M and the interlock mechanism interlocked therewith moves the cleaning roller 40 to the contact position in contact with the carrier belt 38 as shown in FIG. 33. The first mode can include or be referred to as the first cleaning force or effect. Meanwhile, when the second mode is set, the cleaning roller 40 is moved to the remote or non-contact position away from the carrier belt 38. The second mode can include or be referred to as the first cleaning force or effect.

The sensor 200 corresponding to the operation state detection sensor is structured to output the position signal in accordance with the position of the cleaning roller 40. The CPU 91 (as the determination unit) determines whether the cleaning unit 41 has been installed in the body casing based on the cleaning mode to be set and the position signal output from the sensor 200.

Figure 33:
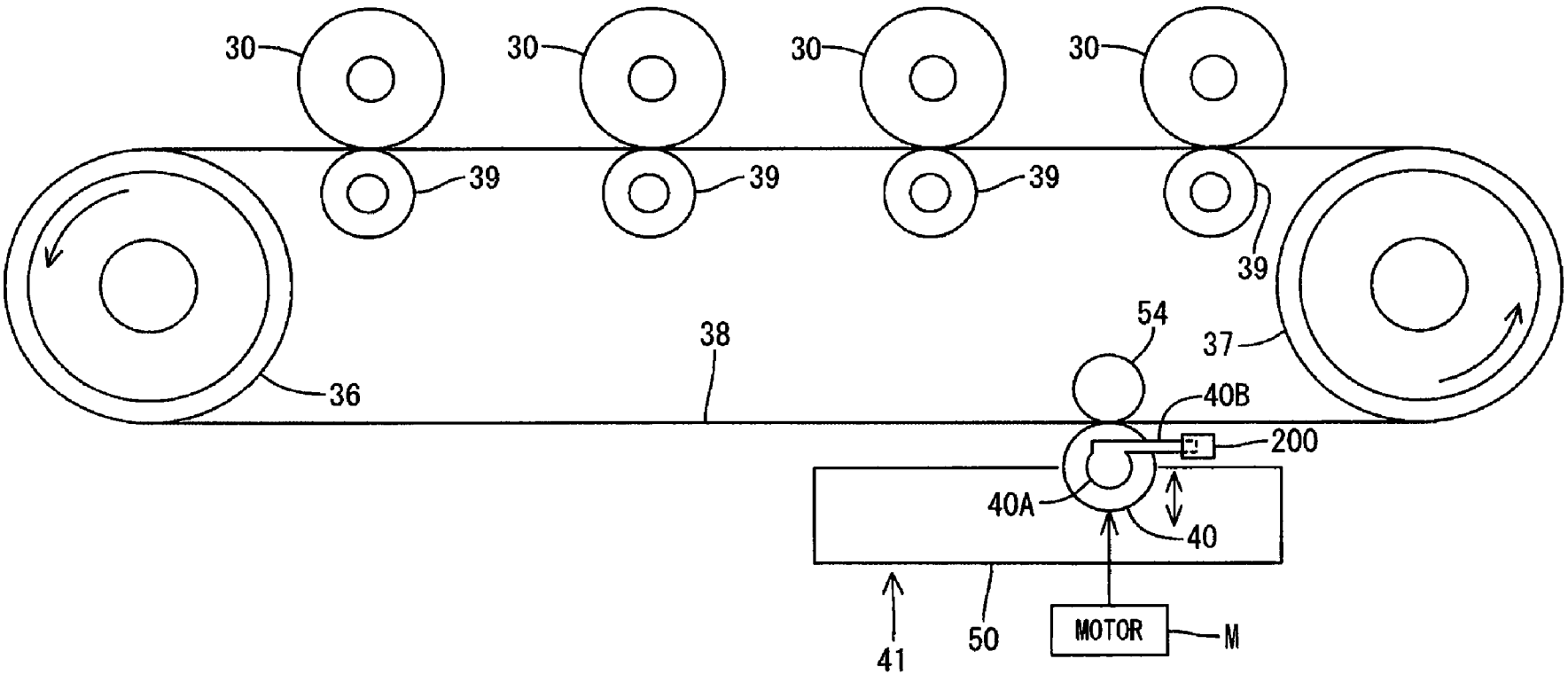
FIG. 33 is an explanatory view conceptually representing the cleaning unit 41 and the structure therearound according to another aspect of the present invention in the state where the first mode has been set.

Specifically, when the first mode is set, the sensor 200 detects the arm 40B (interlocked with the bearing 40A) as shown in FIG. 33. If the detection signal from the sensor 200 is obtained upon setting of the first mode, the CPU 91 determines that the cleaning unit 41 has been installed. Conversely, if the detection signal from the sensor 200 cannot be obtained upon setting of the first mode, it is determined that the cleaning unit 41 has been kept uninstalled. In the aforementioned structure, it is preferable to arrange the sensor 200 at the side of the body of the apparatus. In the aforementioned case, if the cleaning unit 41 has been kept uninstalled, the sensor 200 fails to detect the arm 40B (interlocked with the cleaning roller 40) even if the first mode is set. Accordingly, the invalid signal indicating the non-detection state is output. When the detection signal is not output from the sensor 200 (even if the first mode is set by the CPU 91, that is, when the invalid signal is output), this may indicate that the cleaning unit 41 has been kept uninstalled. This makes it possible to easily determine with respect to the uninstalled state by confirming the set state of the first mode and the detection signal from the sensor 200.

In this aspect, the backup roller 54 is provided for contacting the carrier belt 38 with the cleaning roller 40. The cleaning roller 40 and the backup roller 54 may be moved to be close to or away from the carrier belt 38. That is, the backup roller 54 has the same structure as that of the aspect shown in FIGS. 1 to 14 to allow both members to move to be close to or away from the carrier belt 38. In this aspect, the interlock mechanism 110, which is interlocked with the backup roller 54 as shown in FIG. 12, may be omitted.

<Other Aspects>

The invention is not limited to those described above referring to the drawings, and the following aspects are within the scope of the invention.

Figure 34:
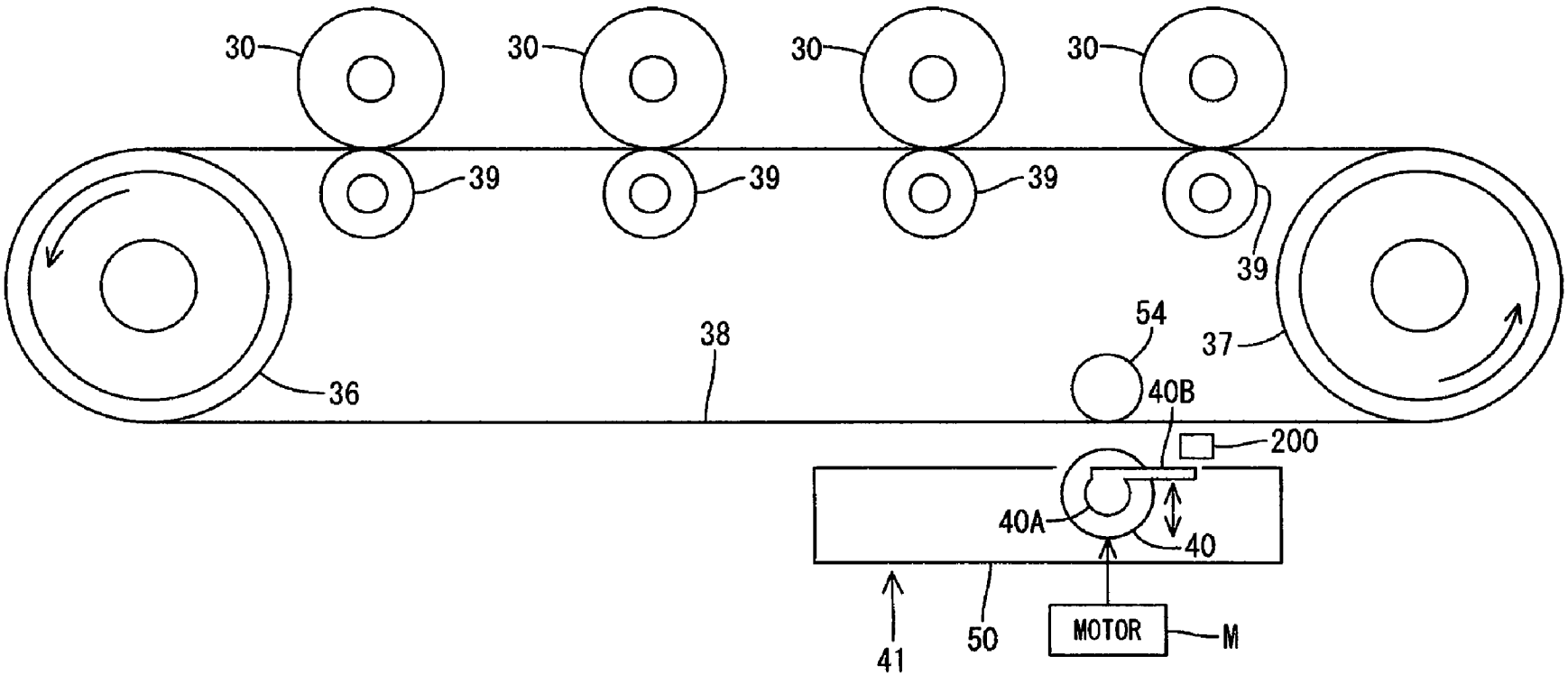
FIG. 34 shows the state where the second mode has been selected from the state shown in FIG. 33.

(1) In the aspect shown in FIGS. 33 and 34, both the cleaning member and the backup member are provided. However, the backup member may be omitted.

Figure 35:
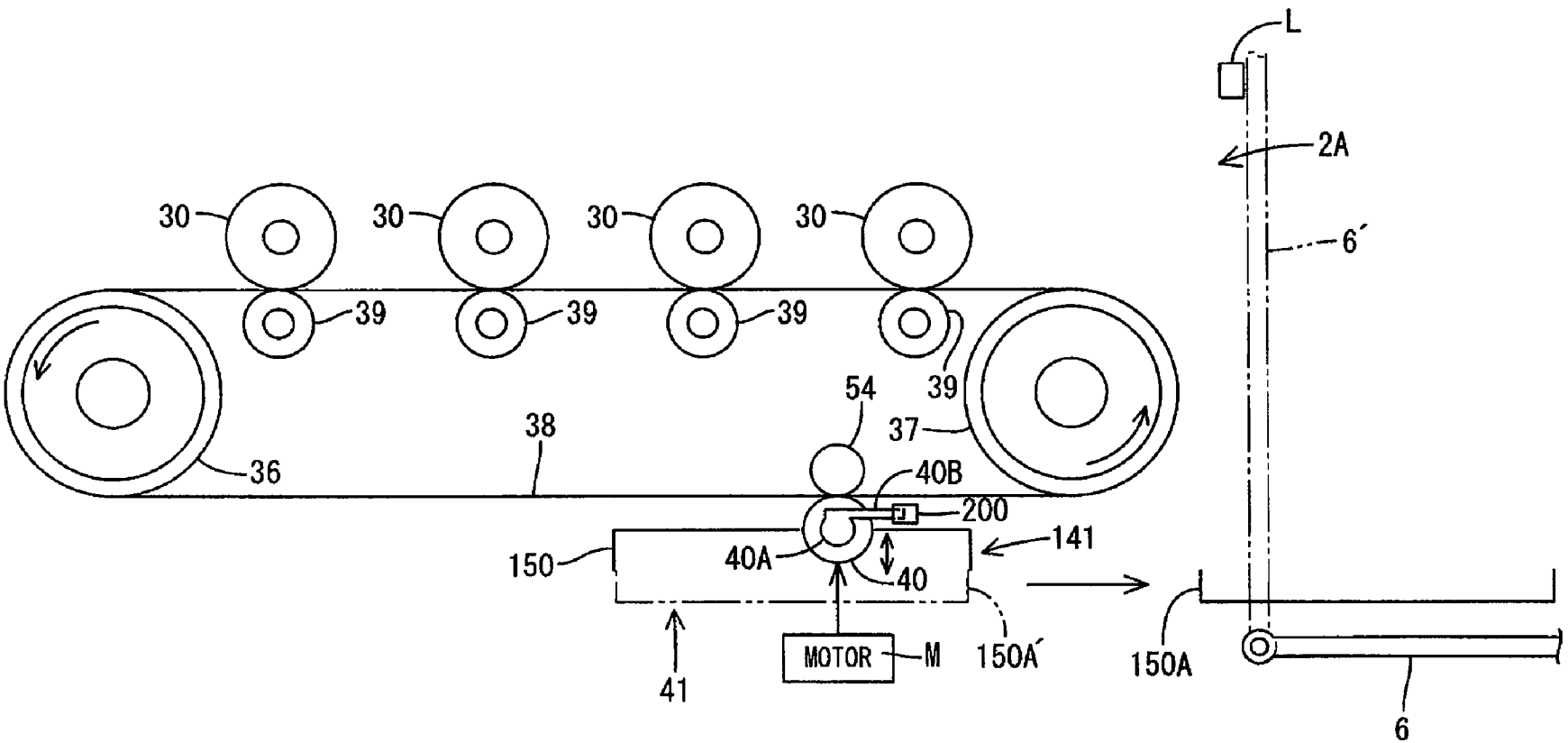
FIG. 35 is an exemplary view through modifying the structure shown in FIG. 33.

(2) In the aforementioned aspect, the storage box (case 50) is structured integrally with the frame of the cleaning unit 41. However, a detachable box 150A (storage box) that can be installed to or detached from a unit body 141 having the cleaning member of the cleaning unit 41 may be provided as shown in FIG. 35. FIG. 35 represents the state where the detachable box 150A is detached, and conceptually represents the state where the detachable box 150A is installed by a chain double-dashed line 150A'.

FIG. 35 is the same as FIG. 33 except that the configuration of the case 150, and a closure detection sensor L. In this case, the detachable box 150A may be structured as a portion of the cleaning unit 41. Alternatively, it may be structured as a portion separate from the cleaning unit 41. In the case where it is structured as a portion of the cleaning unit 41, the cleaning unit 41 (including the detachable box 150A) may be installed or detached as a whole. The detachable box 150A may further be installed or detached by itself. In the case where the detachable box 150A is structured as the separate portion, it may be structured to be installed to or detached from the body casing 2 (see FIG. 1) independent from the cleaning unit 41 as shown in FIG. 35.

In the example shown in FIG. 35, the opening 2A (through which the cleaning unit 41 is detachably installed) is formed in the body casing 2. The cover member 6, which covers opening 2A, but allows opening 2A to open and close, and the closure detection sensor L that detects the closed state of the cover member 6 are provided. It is determined whether the cleaning unit 41 has been installed on the assumption that the closure detection sensor L detects the closed state of the cover member 6. That is, the uninstall state of the cleaning unit 41 is determined upon establishment of the condition for detecting the closed state of the cover member 6. Meanwhile, when the cover member 6 is not closed, the determination is not made. The closure detection sensor L may be formed as a magnetic switch, an optoelectronic switch and the like. FIG. 35 shows an example of the state where the cover member 6 is opened, and conceptually shows the state where the cover member is closed by a chain double-dashed line 6'.

Figure 36:
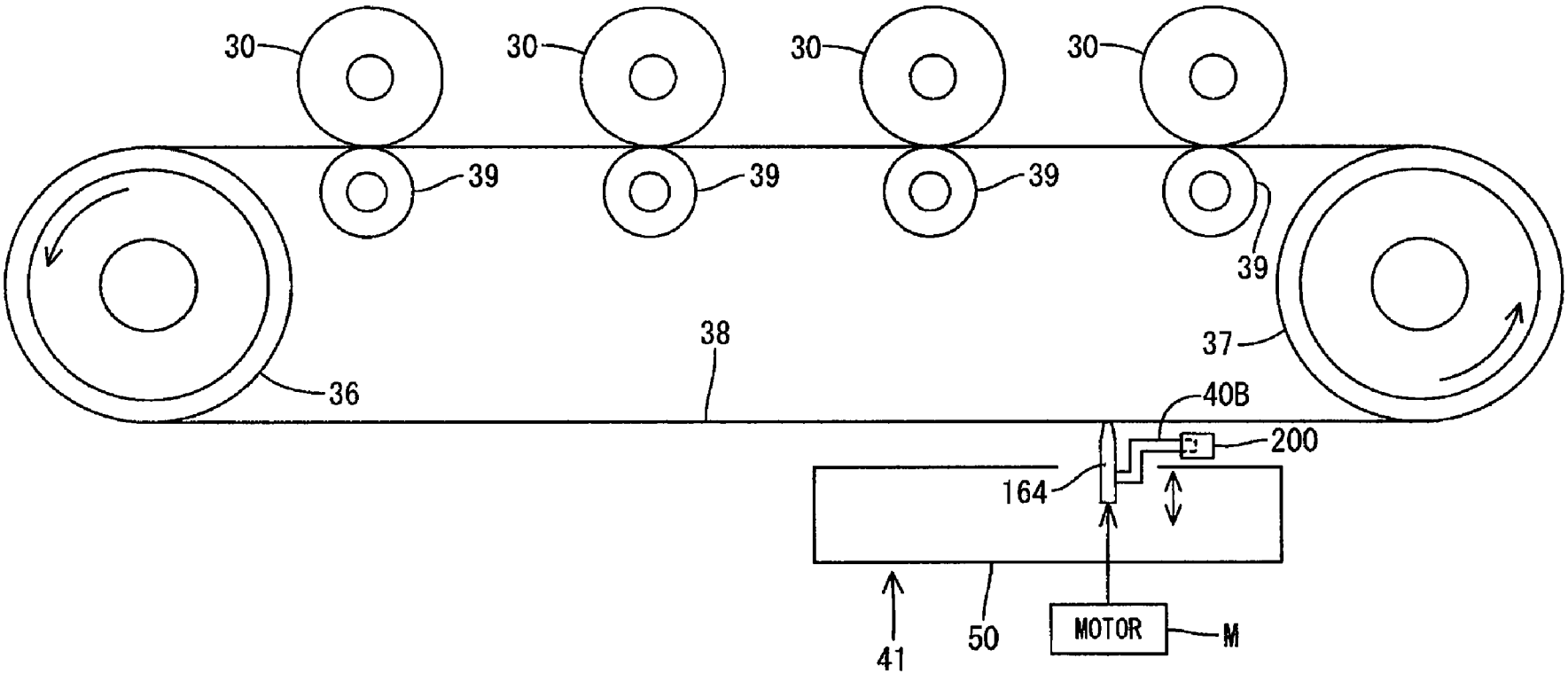
FIG. 36 is an exemplary view through modifying the structure shown in FIG. 33 according to another aspect of the present invention.

(3) The aforementioned aspects show the cleaning member formed as the cleaning roller 40. However, it may be formed as a cleaning blade 164 which scratches off the foreign matter adhered onto the carrier belt 38 as shown in FIG. 36. FIG. 36 is the same as FIG. 33 except that the structure of the cleaning member. It is to be understood that the cleaning roller 40 may be replaced with the cleaning blade not only in the example of FIG. 33 but also in other aspects.

What is claimed is:

1. An image forming apparatus comprising:

a body casing;

a first roller and a second roller in the body casing;

an endless belt looped around the first roller and the second roller and having an inner surface and an outer surface;

a cleaning unit that includes a case, a cleaning mechanism disposed within the case, and a cam, the cleaning mechanism including a cleaning member that is positioned to face and is fixed with respect to the outer surface of the belt;

a backup member that is positioned to face the inner surface of the belt;

a cam-follower coupled to the backup member and in contact with the cam;

wherein the cam-follower displaces the backup member between a contact position and a non-contact position by rotation of the cam.

2. The image forming apparatus according to claim 1, wherein:

when the backup member is placed in the contact position, the backup member contacts the belt; and when the backup member is placed in the non-contact position, the backup member is positioned away from the belt; and upon installment of the cleaning unit in the body casing, the cam is coupled to the cam-follower.

3. The image forming apparatus according to claim 1, wherein the backup member includes a backup plate having a plate surface that is configured to contact the belt.

4. The image forming apparatus according to claim 1, wherein the backup member includes a backup roller having a roller surface that is configured to contact the belt.

5. The image forming apparatus according to claim 1, further comprising a storage box that is configured to collect foreign matter, the foreign matter being adhered onto said belt and being removed by said cleaning mechanism.

6. The image forming apparatus according to claim 5, wherein the storage box is integrally formed with a frame of the cleaning unit.

7. The image forming apparatus according to claim 5, wherein the storage box is detachably installed and includes the cleaning member of the cleaning unit.

8. The image forming apparatus according to claim 5, wherein the storage box is detachably installed in the body casing separately from the cleaning unit.

9. The image forming apparatus according to claim 1, wherein the cleaning member includes a cleaning roller that removes foreign matter adhered onto the belt.

10. The image forming apparatus according to claim 1, wherein the belt is a carrier belt that carries a recording medium.

11. The image forming apparatus according to claim 1, wherein the contact position of the cam with the cam-follower is on the same side of the cleaning roller with respect to the belt and in an opposing direction of the belt and the cleaning member.

12. The image forming apparatus according to claim 1, further comprising a shaft, wherein:

the cam includes a first cam and a second cam;

the shaft holds the first cam and the second cam with a space therebetween; and the belt runs within the space between the first cam and the second cam.

* * * * *